US005356415A

United States Patent [19]

Iwasaki et al.

[11] Patent Number: 5,356,415

[45] Date of Patent: Oct. 18, 1994

[54] DEPILATING DEVICE

[75] Inventors: Juzaemon Iwasaki, Nagahama; Masao Tanahashi; Hidekazu Sueyoshi, both of Hikone, all of Japan

[73] Assignee: Matsushita Electric Works, Ltd., Osaka, Japan

[21] Appl. No.: 836,903

[22] Filed: Feb. 19, 1992

[30] Foreign Application Priority Data

| | | | |
|---|---|---|---|
| Feb. 20, 1991 | [JP] | Japan | 3-026104 |
| Jun. 25, 1991 | [JP] | Japan | 3-152786 |
| Dec. 20, 1991 | [JP] | Japan | 3-338559 |

[51] Int. Cl.[5] ..... A45D 26/00; A61B 17/00

[52] U.S. Cl. ..... 606/133; 606/131

[58] Field of Search ..... 606/131-133

[56] References Cited

U.S. PATENT DOCUMENTS

| | | | |
|---|---|---|---|
| 4,830,004 | 5/1989 | Alazet | 606/133 |
| 5,032,126 | 7/1991 | Cleyet et al. | 606/133 |
| 5,041,123 | 8/1991 | Oliveau et al. | 606/133 |
| 5,084,055 | 1/1992 | Demeester | 606/133 |
| 5,084,056 | 1/1992 | Eckel et al. | 606/133 |
| 5,100,413 | 3/1992 | Dolev | 606/133 |
| 5,100,414 | 3/1992 | Dolev | 606/133 |
| 5,108,409 | 4/1992 | Demeester | 606/133 |
| 5,171,315 | 12/1992 | Cabrero | 606/133 |

FOREIGN PATENT DOCUMENTS

| | | |
|---|---|---|
| 0328426 | 8/1989 | European Pat. Off. . |
| 60-156407 | 8/1985 | Japan . |

*Primary Examiner*—Stephen C. Pellegrino
*Assistant Examiner*—Glenn Dawson
*Attorney, Agent, or Firm*—Nikaido, Marmelstein, Murray & Oram

[57] ABSTRACT

A depilating device removes hairs from the skin of a user and includes a carrier mounting a series of fixed and movable pinching plates arranged along an axial direction of the carrier in an alternating relation and in a closely adjacent relation to form small clearances between the adjacent movable and fixed pinching plates for entrapping hairs therebetween. The fixed pinching plates are kept fixed with respect to the axial direction of the carrier. The movable pinching plates are caused to be displaced in the axial direction relative to the adjacent fixed pinching plates in order to repeat clamping the hairs between the adjacent ones of the fixed and movable pinching plates and releasing the same, thereby plunking the hairs from the skin. The depilating device is characterized in that the fixed and movable pinching plates are arranged and displaced such that the two adjacent ones of the movable pinching plates are caused to shift in the opposite directions along the axis of the carrier against the common fixed pinching plates positioned between these two adjacent movable pinching plates to thereby apply counterbalancing clamping forces to the common one of the fixed pinching plates from the two adjacent movable pinching plates.

12 Claims, 32 Drawing Sheets

132
133
130
135
131
134
135
125
122
120
121
140
149
143
141
147B
144B
142
144A
144A
146B
147B
146A
152
151A
150B
150A
153
151B
153

Fig. 28C
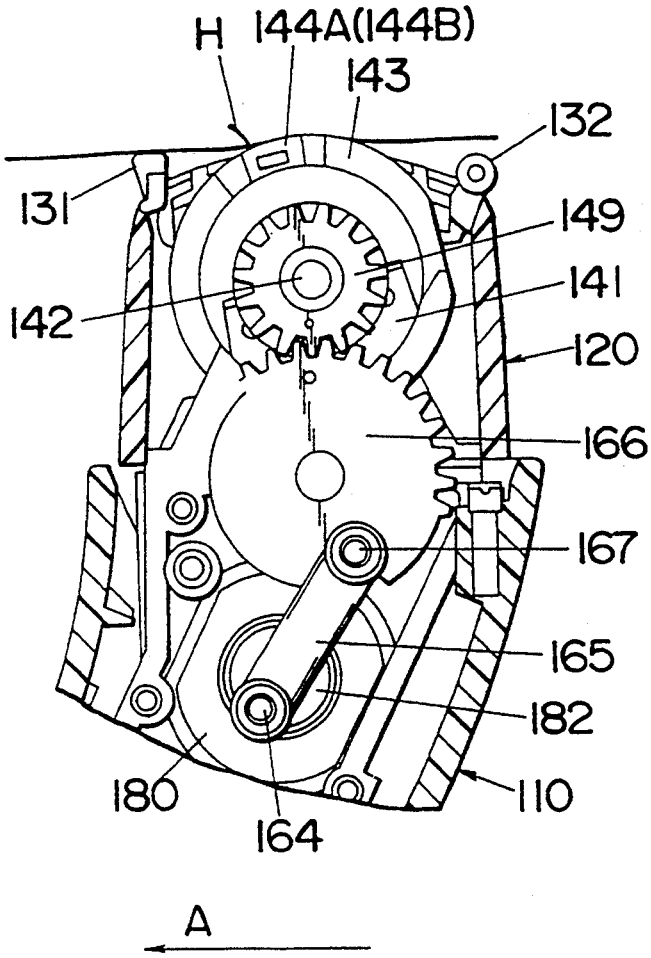
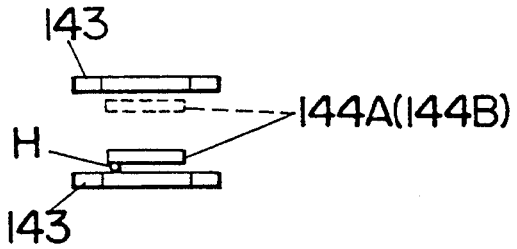
Fig. 29C

DEPILATING DEVICE

BACKGROUND OF THE INVENTION

1. Field of the Invention

The present invention is directed to a depilating device for removing superfluous hairs from the skin for aesthetic reasons or the like.

2. Description of the Prior Art

Depilating devices are known, for example, in Japanese early patent publication (KOKAI) No. 60-156407 and in European Patent Specification No. 0,328,426. The devices of these patents disclose the use of a series of pinching disks supported on a shaft. Each alternate disk is driven to move in one direction at a time along an axis of the shaft in order to clamp hairs between the two adjacent disks for plucking the hairs from the user's skin. During the operation of the prior devices, each pinching disk is displaced axially into abutment against only the adjacent one of the pinching disks at a time. That is, when considering the two adjacent pinching disk as a clamping pair, one of the pinching disks receives a unidirectional clamping force only from the other pinching disk at a time and is therefore very likely to be deformed upon receiving the clamping force or impact to thereby cause vibration. Such vibration is made stronger as a larger clamping force is required to securely clamp the hairs, and therefore brings about undesired and unpleasant noise. Even when the disk is made rigid enough to be free from deformation, there will be an increased impact-noise between the rigid disks. In this sense, the prior devices fail to consistently achieve strong clamping or plucking effect and a silent or low-noise operation. Further, in view of that the disk, upon receiving the clamping force from the adjacent one of the disks, is very likely to be deformed together in the same axial direction, the prior device is required to displace the disks forcibly against the adjacent one of the disks at a time in order to compensate for the deformation and to securely clamp the hairs therebetween. Therefore, the power requirement of the prior devices is inevitably increased as the device is required to achieve more secure clamping or plucking effect.

SUMMARY OF THE INVENTION

The above problems have been eliminated in an improved depilating device of the present invention. The depilating device in accordance with the present invention comprises a carrier having a longitudinal axis and mounting a series of fixed and movable pinching plates arranged along an axial direction of the carrier. The fixed pinching plates are fixed in the axial direction and the movable pinching plates are movable in the axial direction. The fixed and movable pinching plates are positioned in a closely adjacent relation to define small clearances between the fixed pinching plates and the adjacent movable pinching plates for entrapping hairs therebetween. The movable pinching plates are caused to be displaced relative to the adjacent fixed pinching plates along the axial direction in order to repeat clamping the hairs between the adjacent ones of the fixed and movable pinching plates and releasing the same for plunking the hairs from the skin. The characterizing feature of the present invention resides in that the fixed and movable pinching plates are arranged on the carrier and displaced such that the two adjacent ones of the movable pinching plates are caused to be shifted in the opposite directions along the axis of the carrier against a common one of the fixed pinching plates positioned between the two adjacent movable pinching plates to thereby apply counterbalancing clamping forces to each common one of the fixed pinching plates from the two adjacent movable pinching plates. With this unique structure of applying the counterbalancing clamping forces to the common fixed pinching plate from the two oppositely adjacent movable pinching plates, the common fixed pinching plates can be well prevented from substantially deforming in the axial direction, thereby causing no substantial vibration and therefore minimize the operation noise. Also because of that the fixed pinching plate can be prevented from deforming axially, the counterbalancing clamping forces are applied on the common fixed plates without being dissipated or lost. Therefore, it is possible to clamp the hair securely between the fixed and movable pinching plates only with a minimum power requirement of displacing the movable pinching plates to the fixed pinching plate. Thus, the depilating device can be powered, for example, by a small-sized motor of less power requirement.

Accordingly, it is a primary object of the present invention to provide an improved depilating device which is capable of plucking the hairs efficiently, yet reducing operation noise and minimize the power requirement.

Preferably, the movable pinching plates are connected to a pair of first and second sliders which reciprocate in parallel with the axis of the carrier but in opposite directions to each other. Each of the first and second sliders is connected to each alternate one of the movable pinching plates for displacing the two adjacent ones of the movable pinching plates in the opposite directions along the axis of the carrier. The carrier is driven to oscillate about the carrier axis together with the fixed and movable pinching plates in synchronism with the clamping and releasing movement of the movable pinching plates. The movable pinching plates are arranged to alternate with the fixed pinching plate along the axis of the carrier and caused by the sliders to move in such a manner that the clamping movement occurs at each alternate one of the fixed plates during one complete oscillation cycle of the carrier about the axis and occurs at the other alternate one of the fixed plates in another subsequent oscillation cycle of the carrier. That is, each movable pinching plate is caused to move back and forth between the two adjacent fixed pinching plates in such a manner as to clamp the hair against one of the two adjacent fixed pinching plates at one oscillation cycle and clamp the hair against the other fixed pinching plate at another oscillation cycle. In this manner, each one of the movable pinching plate sweeps the whole distance between the two adjacent fixed pinching plates without causing no dead spot therebetween, thereby enabling to use the whole distance as an effective plucking range.

It is therefore another object of the present invention to provide an improved depilating device which is capable of providing a wide effective plucking range over the axial length of the carrier.

In a preferred embodiment, the fixed pinching plates are made of an elastic material in order to alleviate an impact when the adjacent movable pinching plates are displaced against the fixed pinching plate and therefore minimizing an impact noise. This is made possible with the above structure of applying the counterbalancing clamping forces from the two adjacent movable pinching plates to the common fixed pinching plate, as the fixed pinching plate can be held stable without causing substantial deformation in the axial direction which would otherwise weaken the hair clamping between the fixed and the movable pinching plates. Thus, it is possible to minimize the impact noise, yet assuring the effective plucking operation.

It is therefore a further object of the present invention to provide an improved depilating device which is capable of minimizing the noise without sacrifice in the plucking capability.

The fixed pinching plates are preferably formed integrally with the carrier in order to reduce the number of components and therefore facilitate the assembly. The fixed pinching plates and/or the carrier can be made of a material including an antistatic agent so as to avoid the accumulation of static electricity during the continued operation and therefore assure a comfortable use, which is therefore a still further object of the present invention.

The fixed pinching plates may be a composite structure composed of a core member and an outer member having elasticity greater than that of the core member in order to achieve an optimum noise reducing effect.

Moreover, the depilating device are preferably designed so that two outer ones of the fixed pinching plates located on the axial ends of the carrier are formed to have rigidity greater than that of the other fixed pinching plates. The two outer fixed pinching plates of increased rigidity act to protect the movable and fixed pinching plates arranged therebetween from being deformed or damaged when the device is accidentally dropped to the floor.

These and still other objects and advantageous features of the present invention will become more apparent from the following description of the preferred embodiments when taken in conjunction with the attached drawings.

BRIEF DESCRIPTION OF THE DRAWINGS

FIGS. 28A to 28E are vertical sections illustrating the oscillating movement of a plucking assembly of the depilating device;

FIGS. 29A to 29E are explanatory views illustrating the clamping operations of movable pinching plates in correspondence respectively to FIGS. 28A to 28E.

DETAILED DESCRIPTION OF THE EMBODIMENTS

First Embodiment FIGS. 1 to 15

Figure 1:
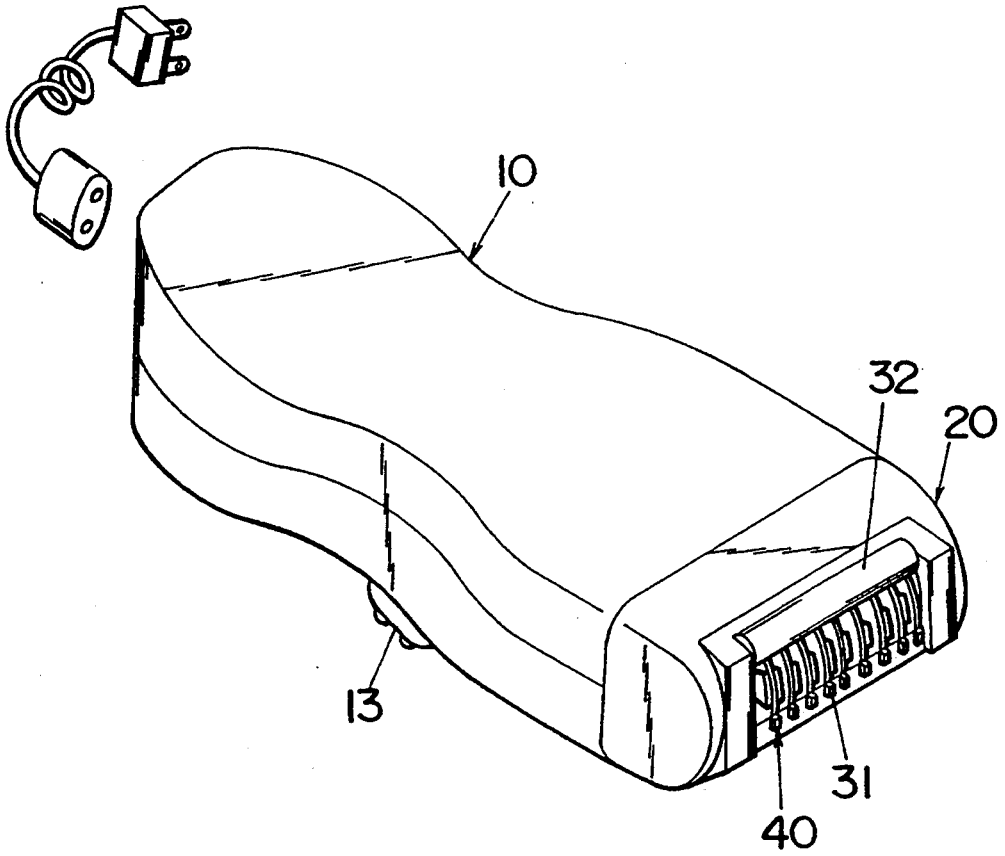
FIG. 1 is a perspective view of a depilating device in accordance with a first embodiment of the present invention.
Figure 2:
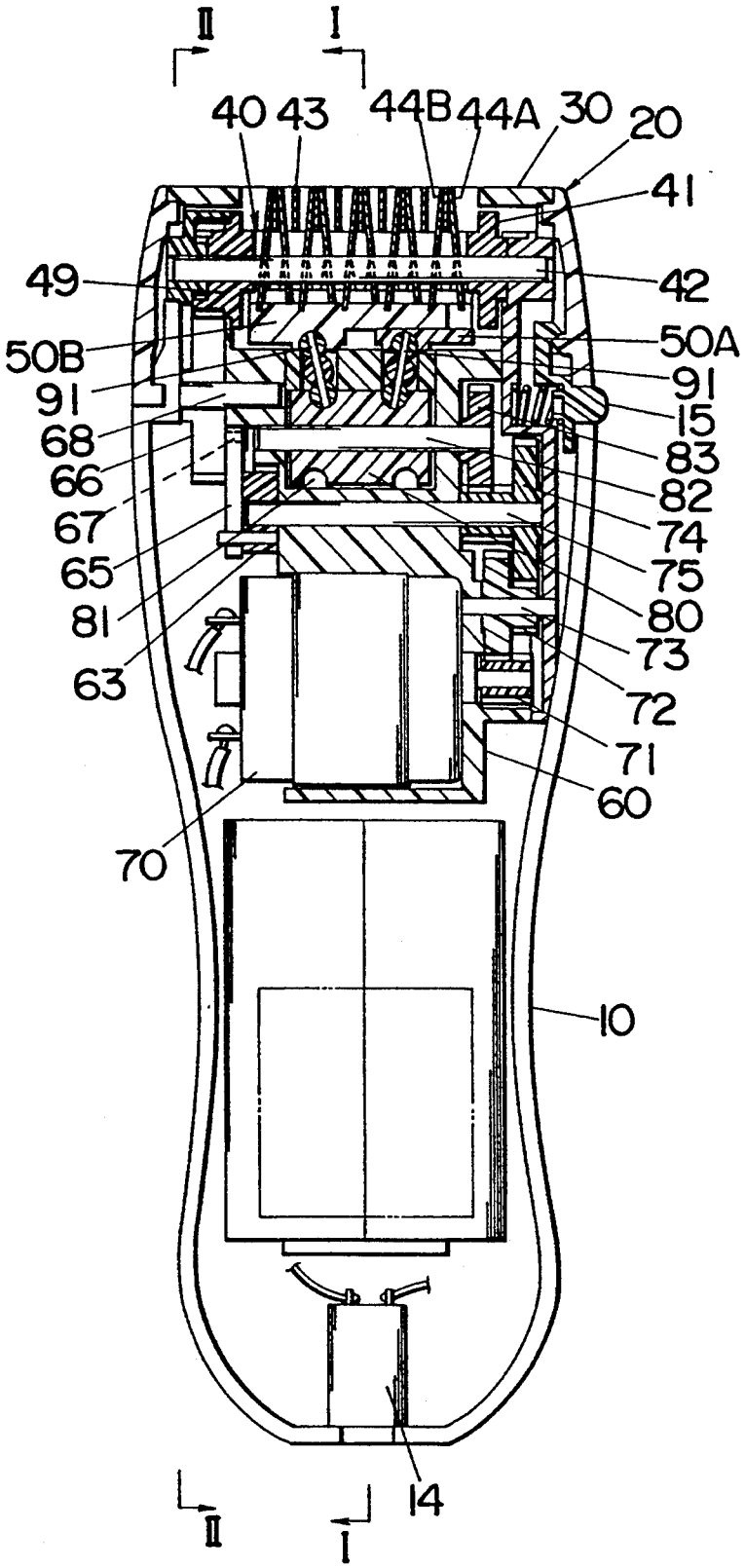
FIG. 2 is a vertical section of the depilating device.
Figure 3:
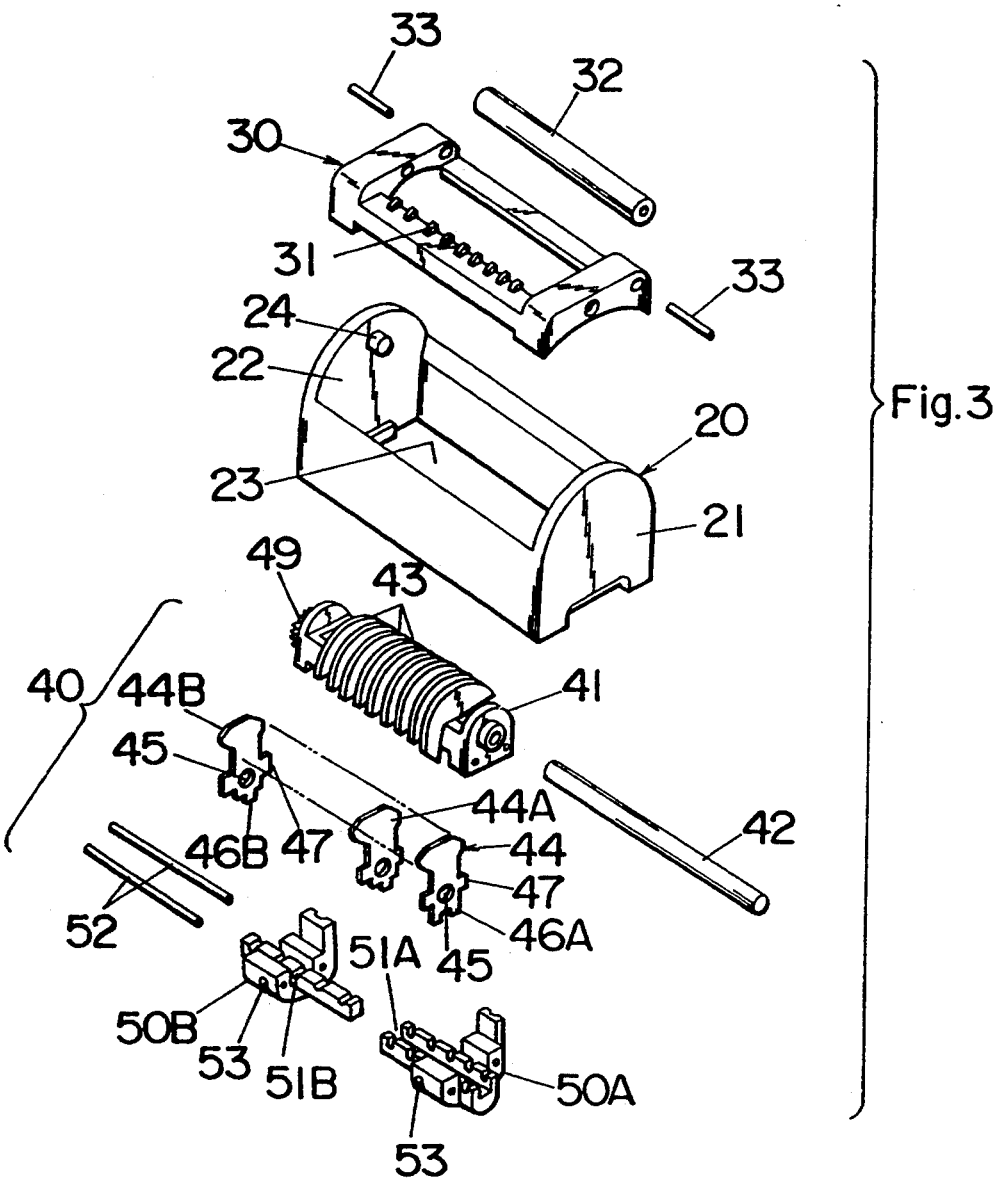
FIG. 3 is an exploded perspective view of a depilator head of the device.
Figure 7:
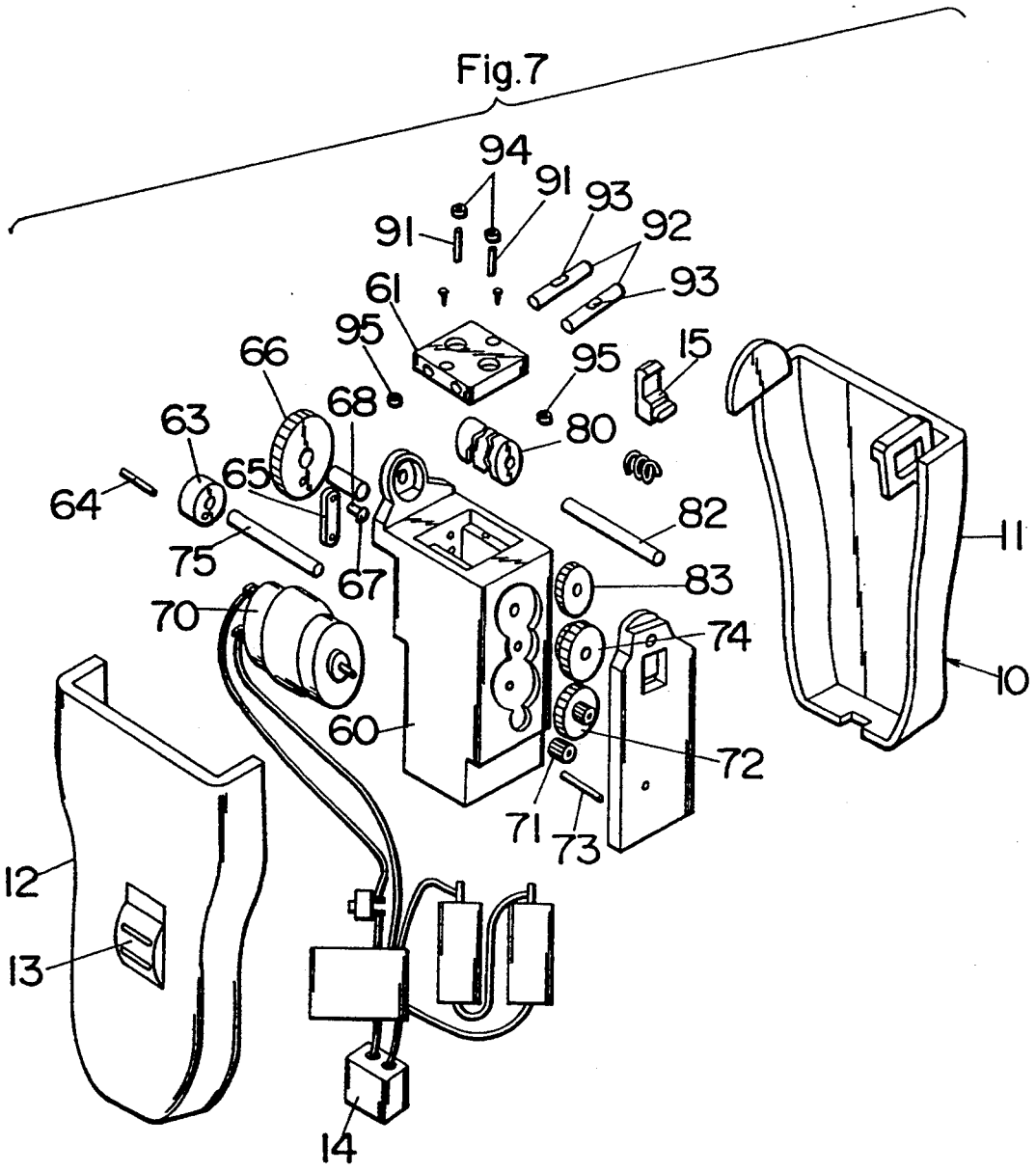
FIG. 7 is an exploded perspective view of a lower portion of the above device.

Referring now to FIG. 1, there is shown a depilating device in accordance with a first embodiment of the present invention. The device comprises a housing 10 and a depilator head 20 mounted on the upper end of the housing 10 to surround a plucking assembly 40 which is responsible for removing the hairs from the skin. As shown in FIGS. 2 and 7, the housing 10 is composed of housing halves 11 and 12 and incorporates an electric motor 70 for driving the plucking assembly 40. The motor 70 is supported by a chassis 60 together with an associated mechanism for driving the plucking assembly 40. The housing 10 is provided with a power switch 13 for energization of the motor 70 directly from an AC main power or through an incorporated rechargeable battery. A socket terminal 14 is provided in the lower end of the housing 10 for electrical connection to an AC power adaptor for charging the battery and energizing the motor 70. As best shown in FIGS. 2 and 3, the depilating head 20 is provided in the form of a rectangular head frame with a pair of end walls 21 and 22 which define therebetween an opening 23 for receiving therein the plucking assembly 40.

The depilating head 20 is detachably mounted on the upper end of the housing 10 by means of a hook 15 and carries a hair smoothening guide 30 which comes into contact with the skin of the user for smoothening the hairs prior to plucking the hairs by the plucking assembly 40. The guide 30 is of a rather flat rectangular configuration with a pair of side bars extending in parallel with the side walls of the head 20. The guide 30 is disposed Within the upper end of the opening 23 and connected to a pair of pins 24 on the end walls of the head 20 so as to swivel about the pins 24 for easily following the contour of the skin when moving the head 20 across the skin of the user. Far smoothening purposes, the guide 30 is formed on one of the side bars with comb projections 31 and is also provided with a roller 32 extending above the other side bar and freely rotatable about corresponding pins 33 supported by the guide 30.

Figure 4:
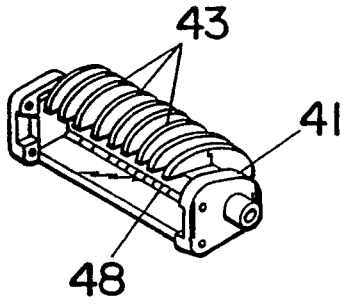
FIG. 4 is a perspective view of a carrier mounting a series of fixed pinching plates of the device.
Figure 5A:
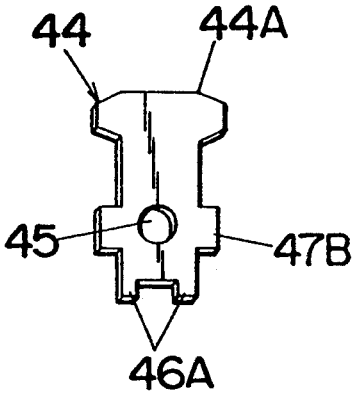
FIGS. 5A and 5B are respectively perspective views of first and second movable pinching plates mounted on the above carrier.
Figure 5B:
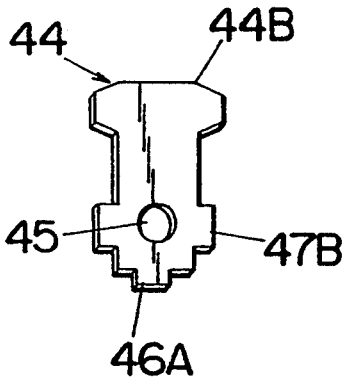

The plucking assembly 40 comprises a carrier 41 rotatably supported about a shaft 42 extending horizontally between the end walls 21 and 22 of the head 20 with its opposite ends journaled to the upper end of the chassis 60. The carrier 41 is provided with a series of fixed pinching plates 43 of somewhat semi-circular configuration arranged along the axis of the shaft. The fixed pinching plates 43 are made of a plastic material showing some elasticity and are molded integrally with the carrier 41 to provide a unitary structure. However, the fixed pinching plates 43 may be separately formed from the carrier 41. Also mounted on the carrier 41 are movable pinching plates 44 which are arranged along the axis of the shaft 42 in an alternating relation to the fixed pinching plates 43. The movable pinching plates 44 are composed of first and second plates 44A and 44B which are commonly supported loosely on the shaft 42 to be rotatable thereabout together with the carrier 41 and the fixed pinching plates 43. The first and second plates 44A and 44B are arranged along the axis of the shaft 42 alternately to each other and are secured at their lower ends respectively to first and second sliders 50A and 50B which are slidably supported by axles 52 held in the lower end of the carrier 41 and which are driven to reciprocate in parallel with the shaft 42 but in the opposite directions to each other, as will be discussed later. The first and second movable pinching plates 44A and 44B are formed at their ends respectively with a single anchor leg 46A and a pair of spaced legs 46B which are press-fitted to corresponding notches 51A and 51B formed in the sliders 50A and 50B, respectively. Each of the movable pinching plates 44A and 44B are also formed to have a pair of side tabs 47 on the opposite sides of a hole 45 through which the shaft 42 extends. The side tabs 47 are press fitted to corresponding grooves 48 formed in the opposite inner side walls of a bottom cavity of the carrier 41, as shown in FIG. 4 (although only one inner side wall is seen in the figure), so that the movable pinching plates 44 are allowed to swing about the individual connections of the side tabs 47 with the grooves 48 toward and away from the adjacent fixed pinching plates 43 as the anchor legs 46 are caused to move axially by the reciprocation of the sliders 50A and 50B. Thus, the movable pinching plates 44 are driven to swing or to have the upper edges displaced axially toward and away from the adjacent fixed pinching plates 43 so as to repeat clamping the hairs between the movable and fixed pinching plates 43 and 44 and releasing the hairs for plucking the hairs in association with an oscillatory movement of the carrier 41 about the shaft 42, the detail of which will be discussed later. In order to minimize an impact noise at the time of contact or collision against the movable pinching plates 44, the fixed pinching plate 43 may be formed into a composite structure of FIG. 6A composed of a core plate 43A and an outer layer 43B covering substantially the entire surface of the core plate 43A and having greater elasticity than the core plate 43A. Also, the fixed pinching plate 43 may be formed into a composite structure of FIG. 6B composed of a core plate 43C and an outer layer 43D covering only the upper end of the core plate 43C and having greater elasticity than the core plate 43C.

Figure 8A:
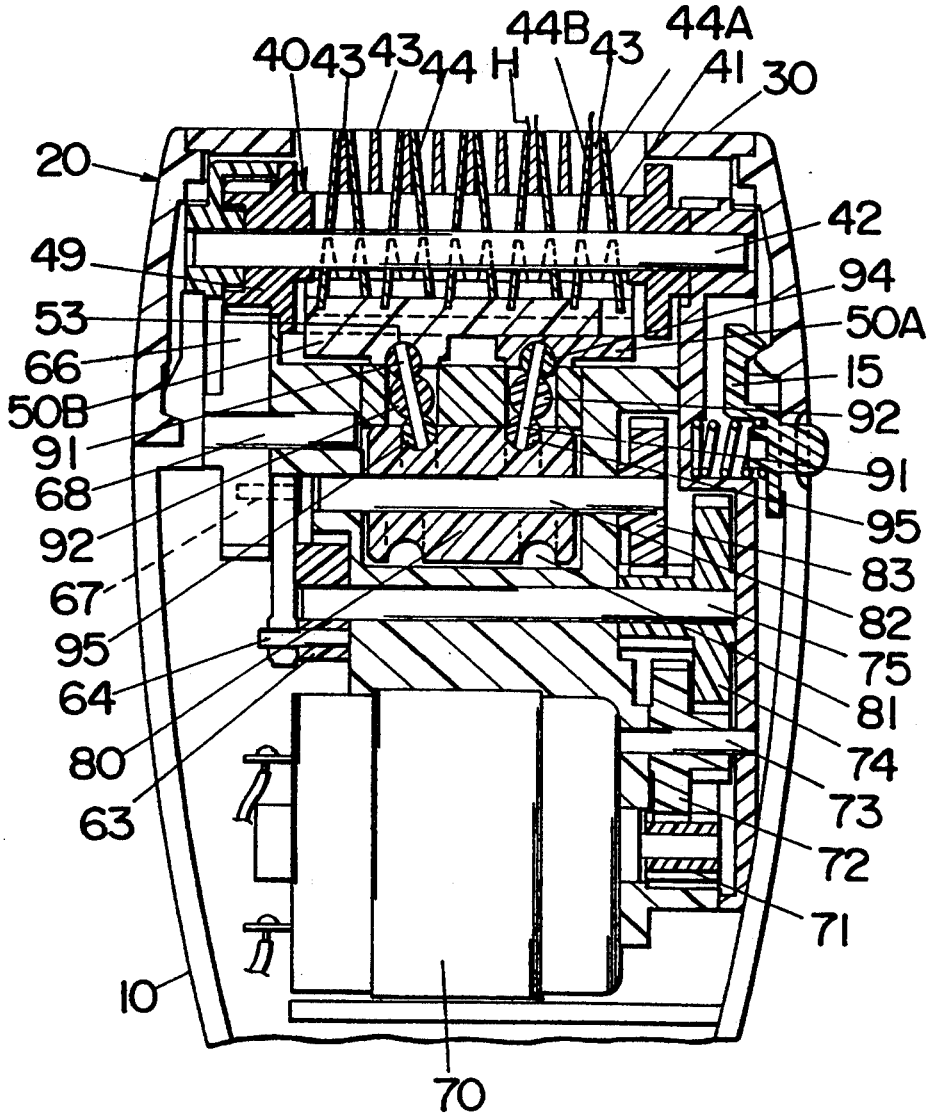
FIGS. 8A and 8B are respectively sectional views illustrating the plucking operation with the movable pinching plates shown in two different axially displaced positions relative to the fixed pinching plates.
Figure 8B:
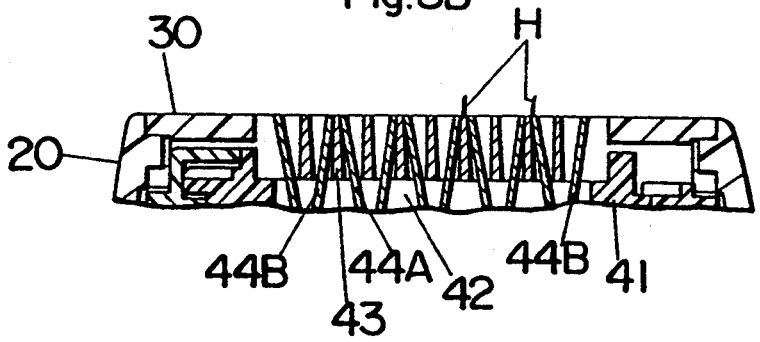
Figure 9:
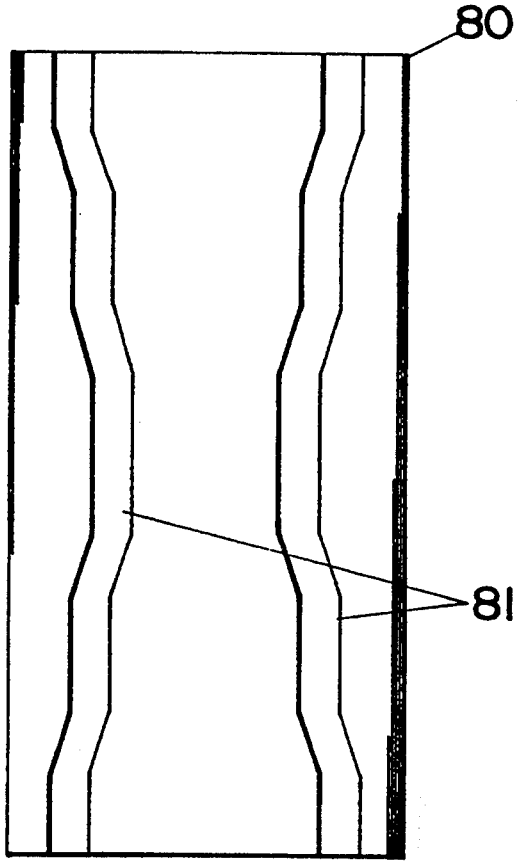
FIG. 9 is an expanded view of a positive-return cam utilized to axially displace the movable pinching plates.
Figure 12A:
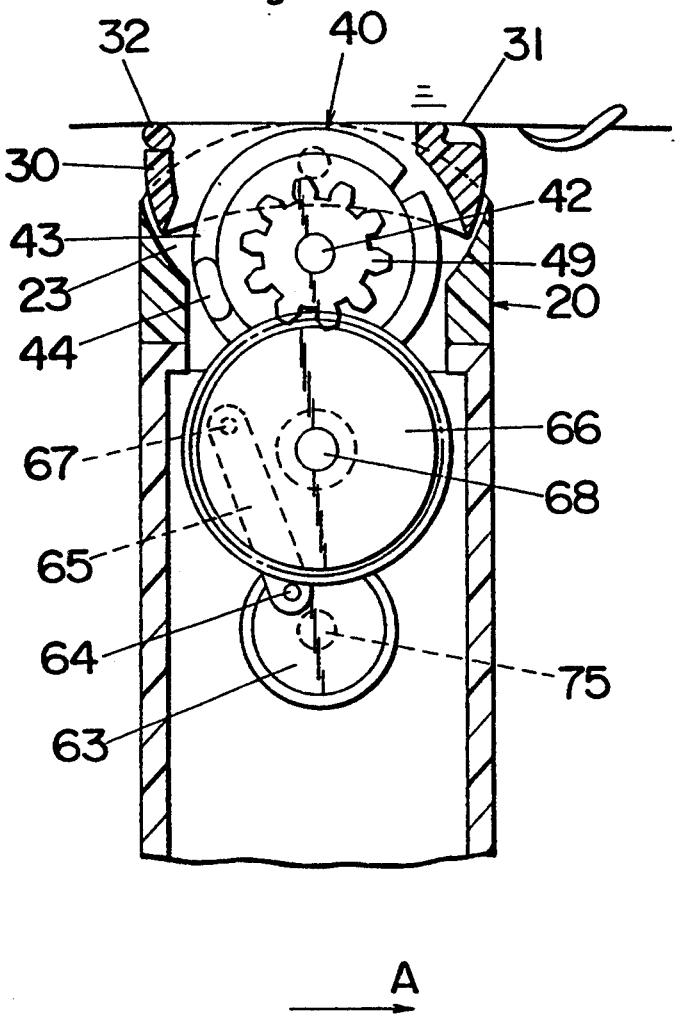
FIGS. 12A to 12E are vertical sections illustrating the oscillating movement of a plucking assembly of the depilating device.
Figure 14:
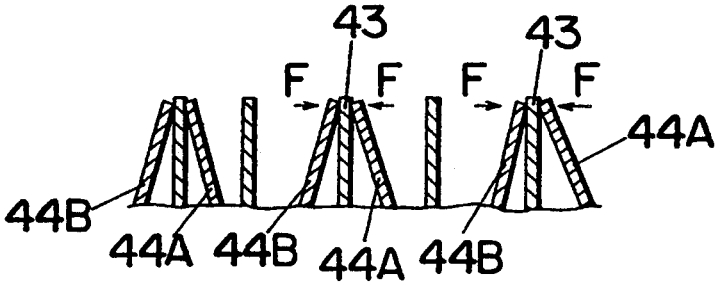
FIG. 14 is an explanatory view illustrating the clamping operation of the movable pinching plate with the corresponding fixed pinching plates.
Figure 15:
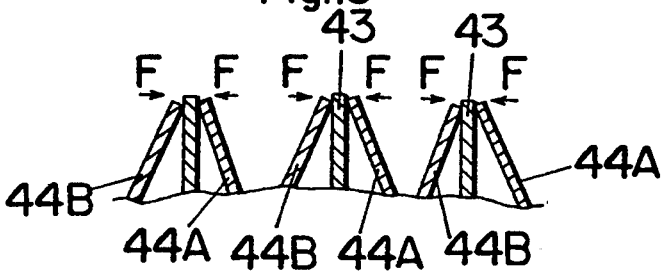
FIG. 15 is an explanatory view illustrating another clamping operation in accordance with a modification of first embodiment.
Figure 16:
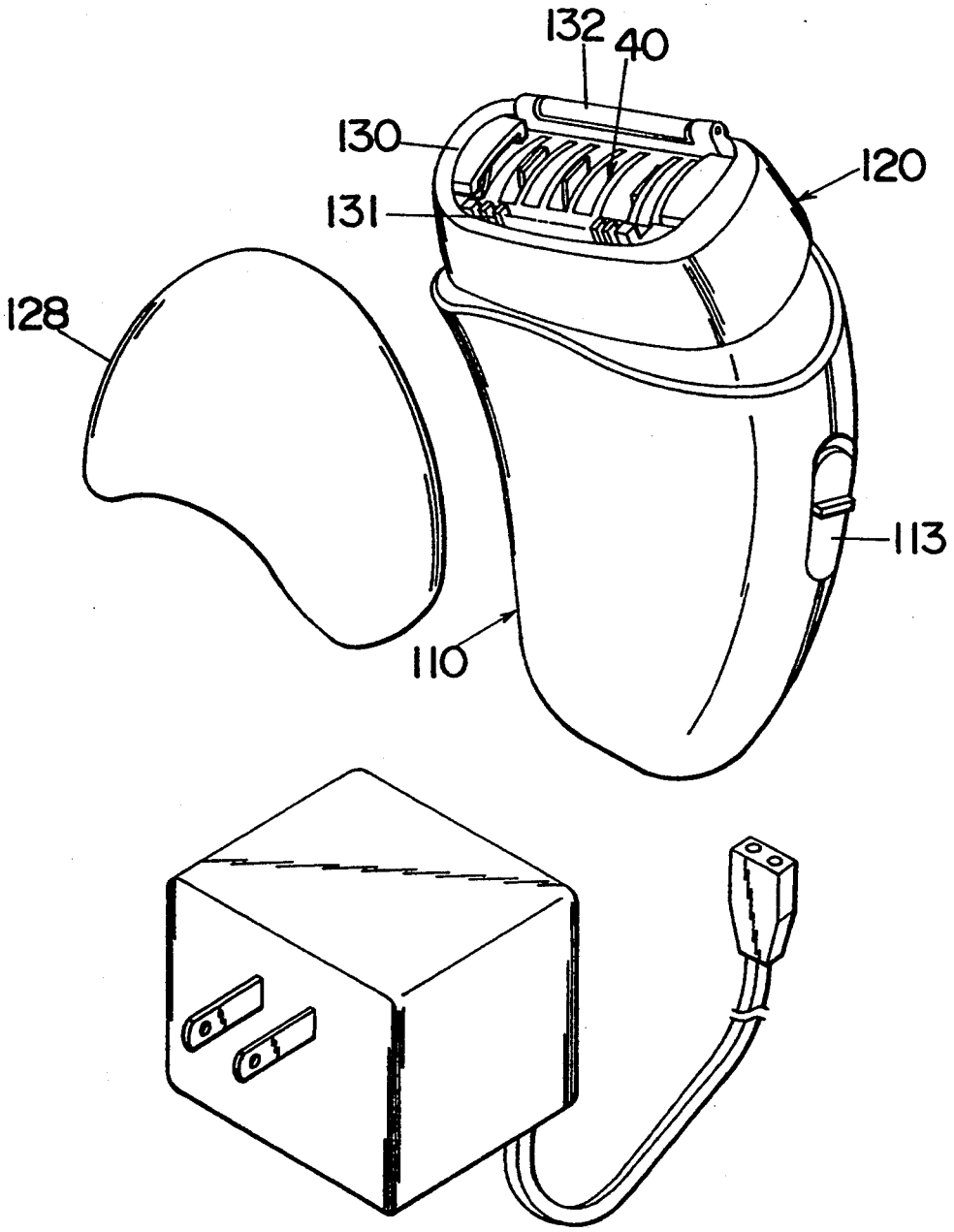
FIG. 16 is a perspective view of a depilating device in accordance with a second embodiment of the present invention.

Turning back to FIGS. 2 and 7, the chassis 60 supports, in addition to the motor 70, a positive-return cam 80 and a plurality of gears for establishing a drive connection from the motor 70 to the positive-return cam 80 as well as for oscillating the carrier 41 or the plucking assembly 40 about the shaft 42. The positive-return cam 80 is provided in the form of a cylinder with a pair of circumferentially extending grooves 81 which are symmetrical to each other such that the horizontal distance between the grooves varies in the circumferential direction, as shown in FIG. 9. The cam 80 is supported on a horizontally extending center shaft 82 to be rotatable therewith and is operatively connected at the grooves 81 to the sliders 50A and 50B by means of universal joints. Each joint comprises a vertical swivel 91 and a horizontal swivel 92 which is inserted into a top plate 61 of the chassis 60 to be freely rotatable therein. The vertical swivel 91 extends through a hole 93 in the middle of the horizontal swivel 92 so as to swivel freely within a vertical plane to a limited extent. As best shown in FIG. 8A, the vertical swivel 91 is provided at its upper and lower ends with a roller 94 and a cam follower 95, respectively. The roller 94 of each vertical swivel 91 is slidably received in an arcuate furrow 53 formed in the bottom of each of the sliders 50A and 50B, while the cam follower 95 is slidably received in each of the grooves 81. The roller 94 of each vertical swivel 91 is slidably received in an arcuate furrow 53 formed in the bottom of each of the sliders 50A and 50B, while the cam follower 95 is slidably received in each of the grooves 81. Thus, the rotation of the positive-return cam 80 cause the sliders 50A and 50B to reciprocate along the axis of the shaft 42 in opposite directions, thereby displacing a set of alternate movable pinching plates 44A in the same direction and at the same time displacing the other alternate set of the movable pinching plates 44B in the opposite direction. In this manner, every set of two adjacent movable pinching plates 44A and 44B are caused to swing in the opposing directions to have their upper edges abutted against on both sides of the common fixed pinching plate 43 located between the two adjacent movable pinching plates 44A and 44B in order to clamp the hairs H therebetween. In other words, the fixed pinching plates 43 receives counterbalancing clamping forces at a time from the two adjacent movable pinching plates 44A and 44B, as shown in FIGS. 14 and 15, so that the fixed pinching plates 43 can be held in place without being substantially deformed, fluttered, or vibrated in the axial direction, which assures a dynamically-balanced and low-noise operation. It is noted in this connection that, as seen in FIG. 3, the sliders 50A and 50B are configured to be capable of overlapping to each other in their reciprocating movement for displacing the movable pinching plates 44A and 44B in the opposed directions.

Figure 11:
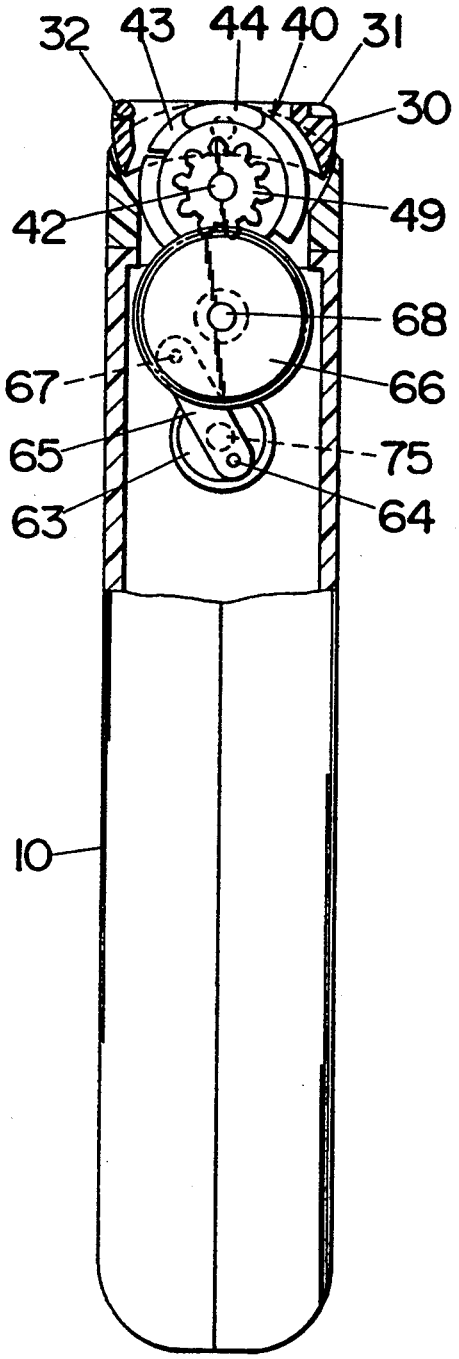
FIG. 11 is a vertical section taken along line II—II of FIG. 2.
Figure 12C:
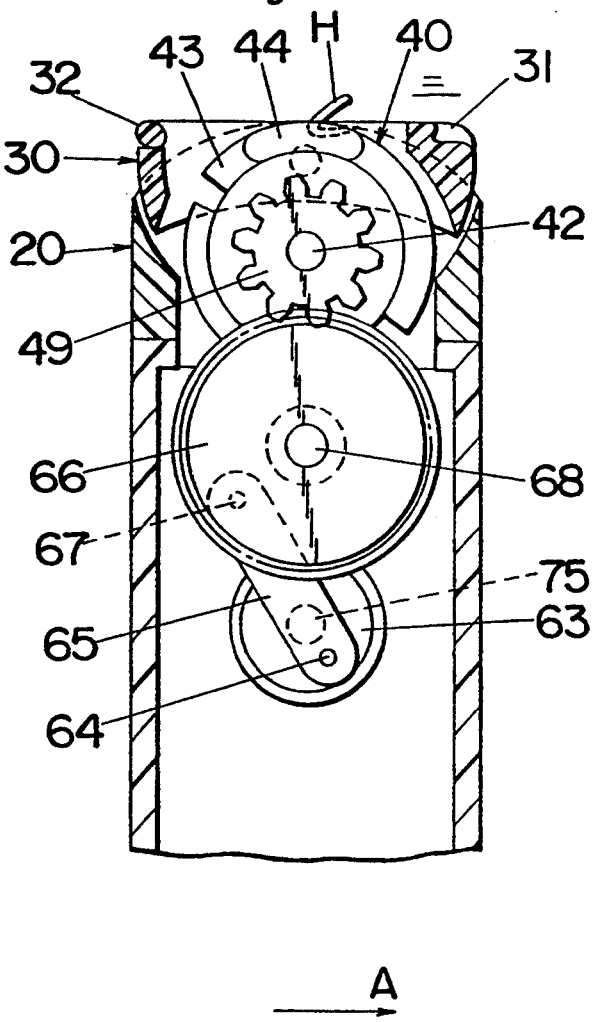

The motor 70 is operatively connected to the positive-return cam 80 through a reduction gear train of a pinion 71 of the motor 70, a first gear 72 gear on a first shaft 73, a second gear 74 and a on a second shaft 75, a third gear 83 on one end of the shaft 82 of the positive-return cam 80. The first and second shafts 73 and 75 are held in the chassis 60 in a parallel relation to the shaft 42. A cam 63 is carried on one end of the second shaft 75 opposite to the second gear 74 so as to be rotatable therewith and is provided with an eccentric pin 64 which is eccentric to the axis of the second shaft 75 and which is connected to one end of a crank lever 65. The other end of the crank lever 65 is connected to a gear wheel 66 by means of a pivot pin 67 at a point radially outwardly of a shaft 68 carrying the gear wheel 66. As best shown in FIG. 11, the gear wheel 66 is in meshing engagement with a gear 49 on one end of the shaft 42 of the carrier 41 so that the rotation of the eccentric pin 64 about the second shaft 75 is translated into an oscillating rotary movement of the gear wheel 66 about the shaft 68 and therefore the corresponding movement of the gear 49 or the plucking assembly 40 about the shaft 42. That is, the plucking assembly 40 is caused to oscillate about the shaft 42 in synchronism with the above-described plucking movement of displacing the movable pinching plates 44 in the axial direction of the shaft 42, and is so arranged to complete one oscillation cycle while the positive-return cam 80 rotates one-half about the center shaft 82 such that the movable pinching plate 44 is caused to move toward and away from one of the two adjacent fixed pinching plates 43 during one oscillation cycle of the plucking assembly 40 about the shaft 42 and to move toward and away from the other fixed pinching plate 43 during subsequent one oscillation cycle of the plucking assembly 40.

Figure 13A:
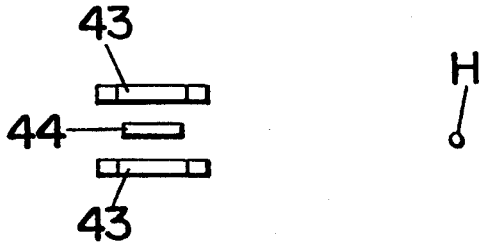
FIGS. 13A to 13E are explanatory views illustrating the clamping operations of movable pinching plates in correspondence respectively to FIGS. 12A to 12E.
Figure 12B:
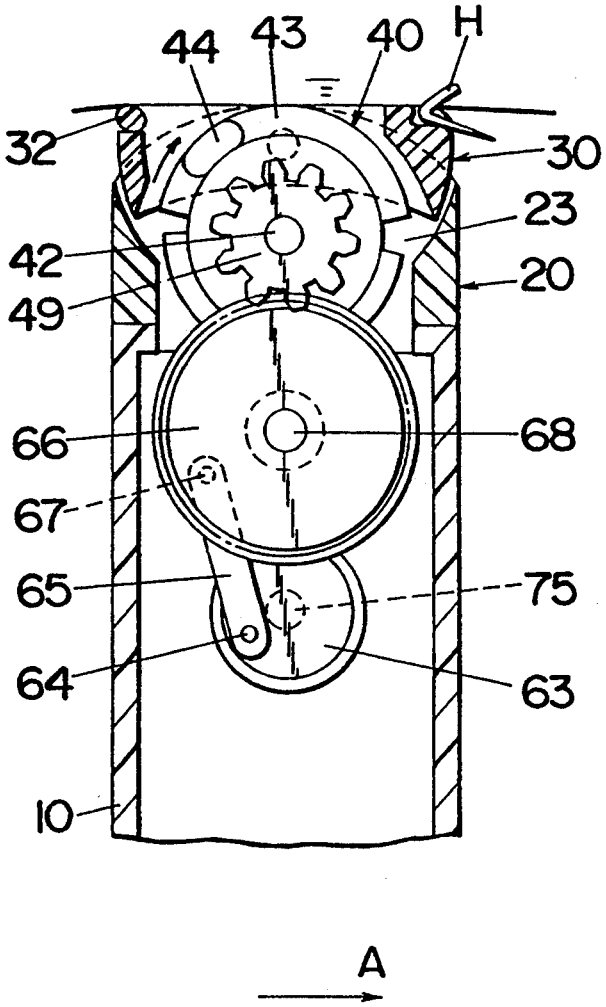
Figure 13B:
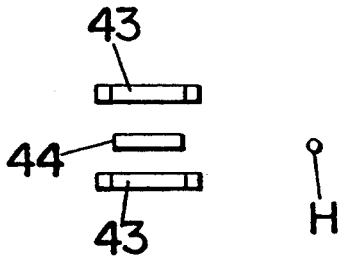
Figure 10:
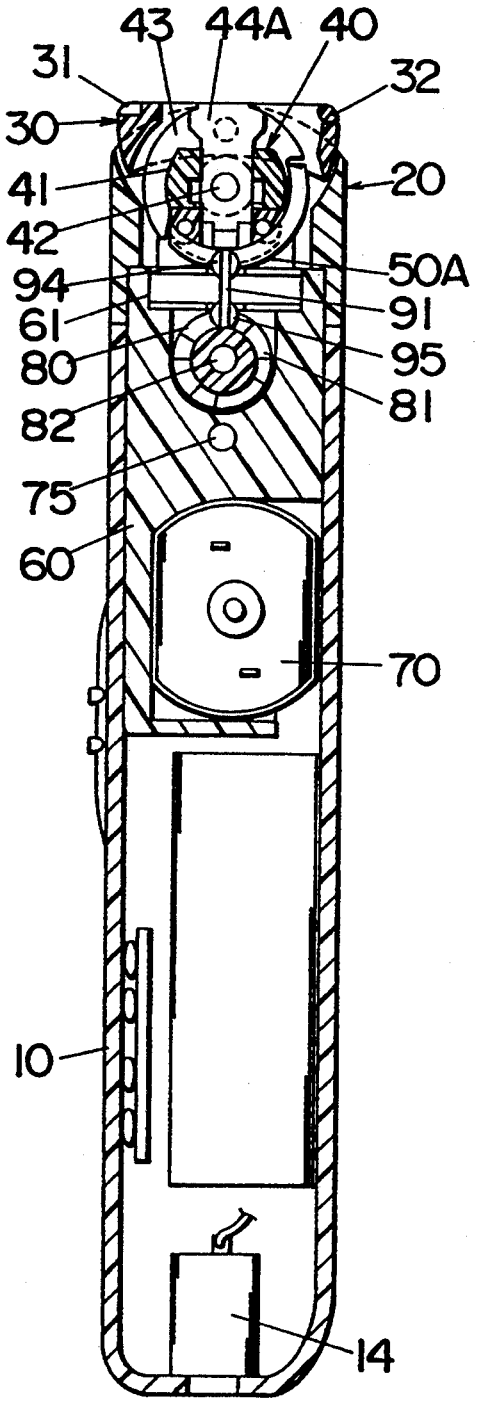
FIG. 10 is a vertical section taken along line I—I of FIG. 2.
Figure 13C:
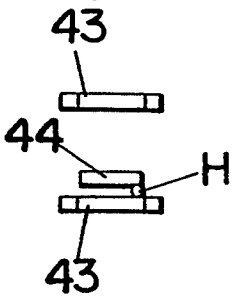
Figure 12D:
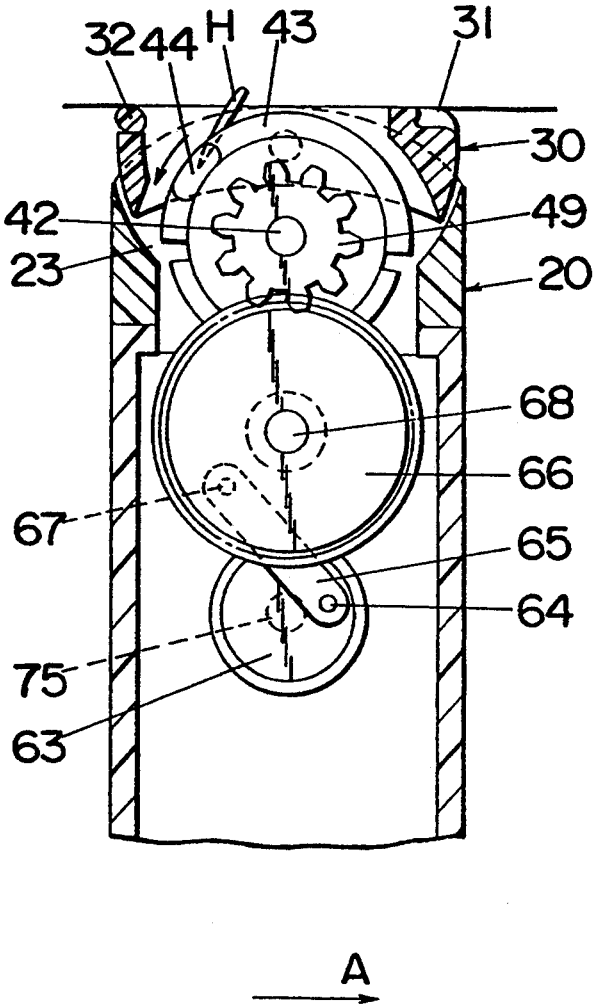
Figure 13D:
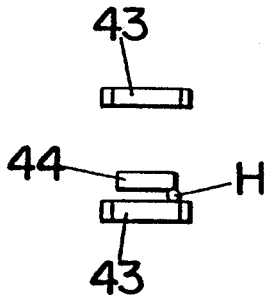
Figure 12E:
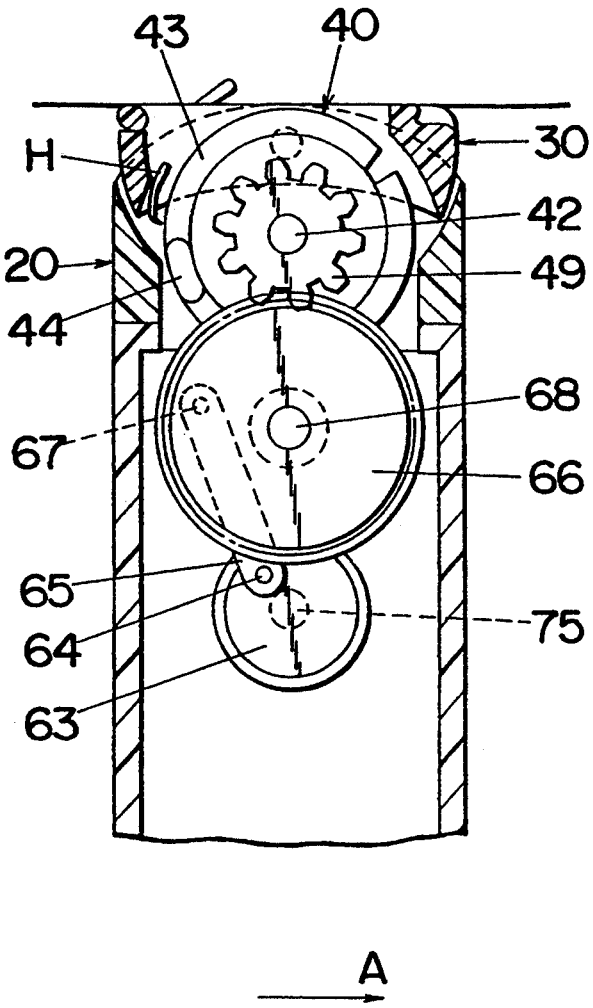
Figure 13E:
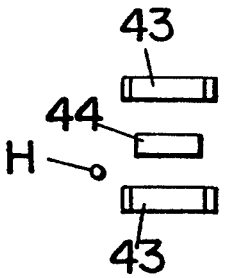

The operation of the plucking assembly 40 will be now discussed with reference to FIGS. 12A to 12E and 13A to 13E which illustrate in sequence one oscillation cycle of the plucking assembly 40 about the shaft 42. When the plucking assembly 40 is in a position of FIG. 12A, the upper edge of the movable pinching plate 44 is angularly displaced downward to be hidden within the opening 23 of the depilator head 20 and at the same time the movable pinching plate 44 is kept in a neutral position where the upper edge thereof is spaced axially along the shaft 42 from both of the two adjacent fixed pinching plates 43, as shown in FIG. 13A. As the plucking assembly 40 rotates in a clockwise direction in the figure about the shaft 42 from the position of FIG. 12A to a position of FIG. 12B to rotate the movable pinching plates 44 for exposure into the opening 23 of the depilator head 20 while advancing the head 20 along the user's skin in the direction indicated by an arrow A in the figures, the movable pinching plate 44 is still kept in spaced relation to the two adjacent fixed pinching plates 43, as shown in FIG. 13B, so as to be ready for entrapping the hair H into a clearance between the movable pinching plate 44 and the fixed pinching plate 43. When the plucking assembly 40 is rotated further to the position of FIG. 12C while being further advanced in the direction of the arrow A, the movable pinching plate 44 is caused to axially shifted to have its upper end engaged with one of the two adjacent fixed pinching plates 43 to clamp the hair H therebetween, as shown in FIG. 13C. Thereafter, the plucking assembly 40 is caused to rotate in the reverse direction, i.e., counter-clockwise direction in the figure to a position of FIG. 12D, at which condition, the movable pinching plate 44 is kept in closed relation to the corresponding fixed pinching plate 43 so as to keep clamping the hair M therebetween, as shown in FIG. 13D, to thereby pull and remove the hair H from the skin as the plucking assembly 40 rotates about the shaft 42. Subsequently, when the plucking assembly 40 is further rotated in the counter-clockwise direction to return to a position of FIG. 12E which is the same position of FIG. 12A, the movable pinching plate 44 is caused to move away from the fixed pinching plate 43 and returns into the neutral position, during which the hair H is released and flew circumferentially out of the plucking assembly 40 by a centrifugal force acting thereon. At this time, the positive-return cam 80 has completed one-half rotation so that, in the immediately subsequent one oscillation cycle of the plucking assembly 40 or in subsequent one-half rotation of the cam 80, the movable pinching plate 44 is caused to move toward and away from the other fixed pinching 43 so as to cooperate therewith for effecting the like plucking operation. In this manner, each movable pinching plate 44 is caused to move axially along the shaft 42 between the two adjacent fixed pinching plates 43 to clamp the hair with the one fixed pinching plate 43 at a time and the hair with the other fixed pinching plate 43 at the other. Thereby, a whole distance between the two adjacent fixed plates 43 can be best utilized as an effected plucking length. It should be noted here that, since the set of alternate movable pinching plates 44A and the other alternate set of the movable pinching plates 44B are caused to move in the opposite direction along the shaft 42, the two adjacent movable pinching plates 44A and 44B are simultaneously brought into abutment against the one common fixed pinching plate 43 positioned therebetween to apply counterbalancing forces F to the fixed pinching plate 43 at a time, as shown in FIG. 14, thus canceling otherwise occurring undesired vibrations of the fixed pinching plates 43 and therefore minimizing the operation noise. Although the first embodiment discloses to arrange the movable pinching plates 44 in an alternating relation to the fixed pinching plates 43, as shown in FIG. 14, it is equally possible to arrange the two movable pinching plates 44A and 44B between the two adjacent fixed pinching plates 43, as shown in FIG. 15, while effecting to apply counterbalancing forces F to the common fixed pinching plate 43 from the adjacent two movable pinching plates 44A and 44B.

Second Embodiment FIGS. 16 to 30

Figure 19:
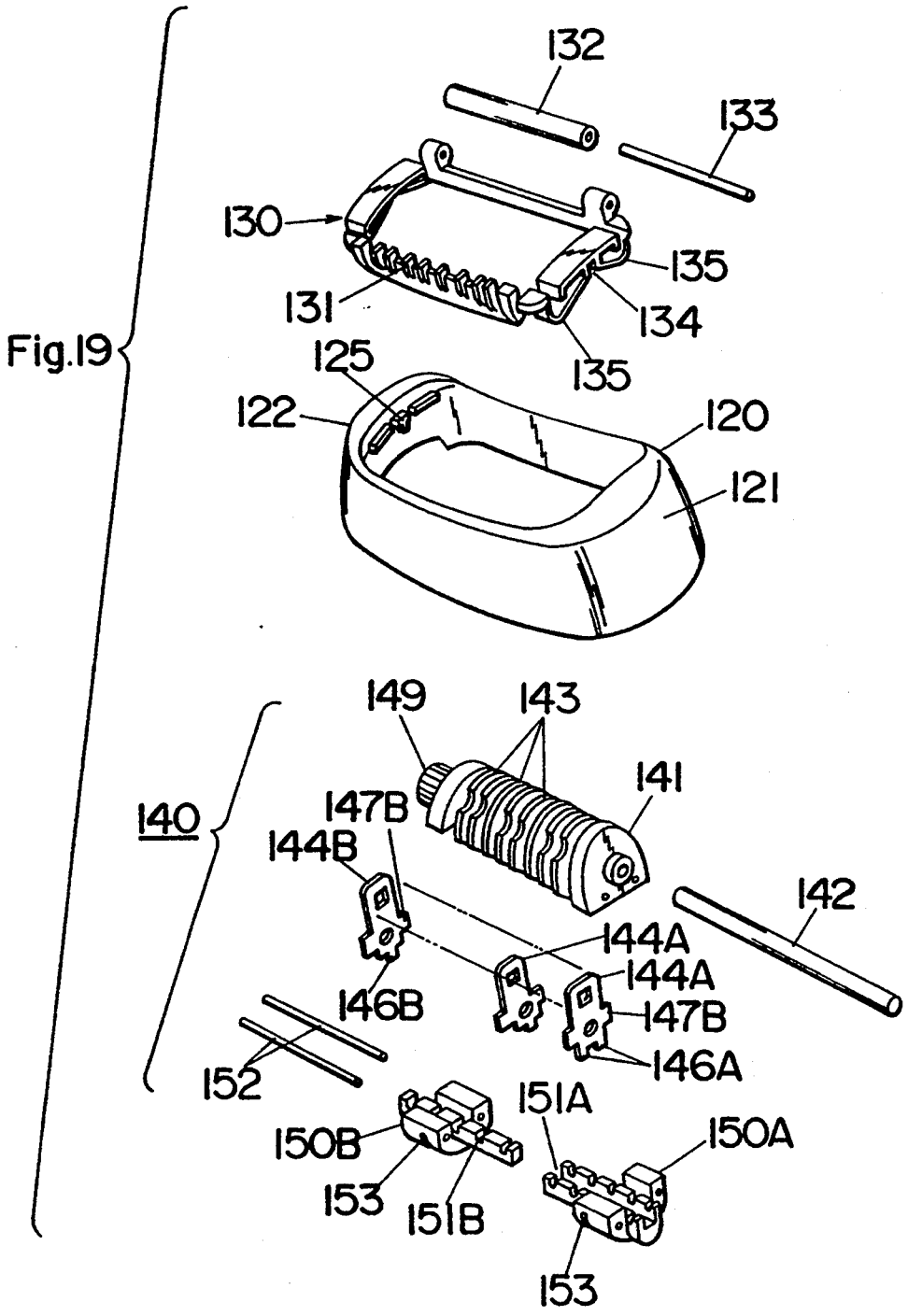
FIG. 19 is an exploded perspective view of a depilator head of the above device.

Referring to FIGS. 16 to 20, there, is shown a depilating device in accordance with a second embodiment of the present invention. The device comprises a depilator head 120 mounted on a housing 110 and including a plucking assembly 140. The housing 110 incorporates a chassis 160 mounting a motor 170, a positive return cam 180, and a drive mechanism for the plucking assembly 140. The housing 110 is provided with a switch handle 113 for turning on and off the motor 170 and also with a pair of terminal pins 114 for electrical connection to an AC power adaptor to energize the motor 170. As best shown in FIG. 19, the head 120 is in the form of a top and bottom opened rectangular frame having a pair of end walls 121 and 122 between which the plucking assembly 140 is received. The head 120 is detachably mounted on the upper end of the housing 110 by means of a hook 115 and carries a hair smoothening guide 130 which comes into contact with the skin of the user for smoothening the hairs prior to plucking the hairs by the plucking assembly 140. A head cap 128 is provided to fit over the head 120 for protection thereof when not in use. The guide 130 is of a rather flat rectangular configuration with a pair of side bars extending in parallel with the side walls of the head 120 and a pair of opposed end bars with center dents 134. The guide 130 is fitted within the upper end of an opening 123 by engagement of bosses 125 at the center of the end walls 121 and 122 into the dents 134. The end bars of the guide 130 are each formed with a pair of generally L-shaped resilient segments 135 which extends laterally in the opposite directions from the dent 134 and terminates in the longitudinal end of the front and rear side bars, respectively, so that the front and rear side bars are allowed to flex upward and downward to a some extent. The front side bar is slotted to give a comb projection 131 for smoothing the hairs, while the rear side bar carries a roller 132 in rolling contact with the user's skin for facilitating to move the cutter head 120 across the skin. The roller 132 is supported to be rotatable about a pin 133 journaled at the opposite ends to the rear side bar.

Figure 20:
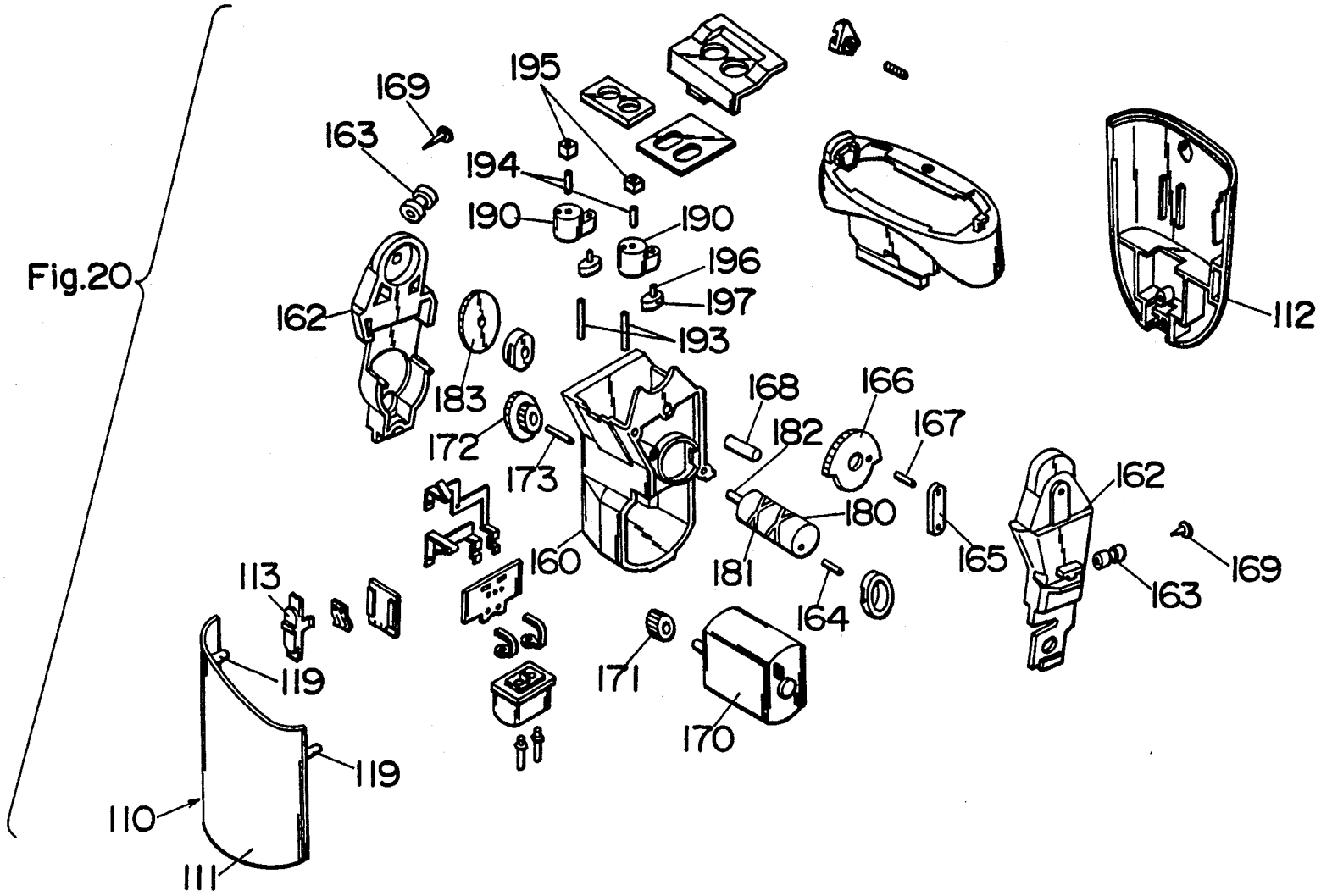
FIG. 20 is an exploded perspective view of a lower portion of the above device.
Figure 21:
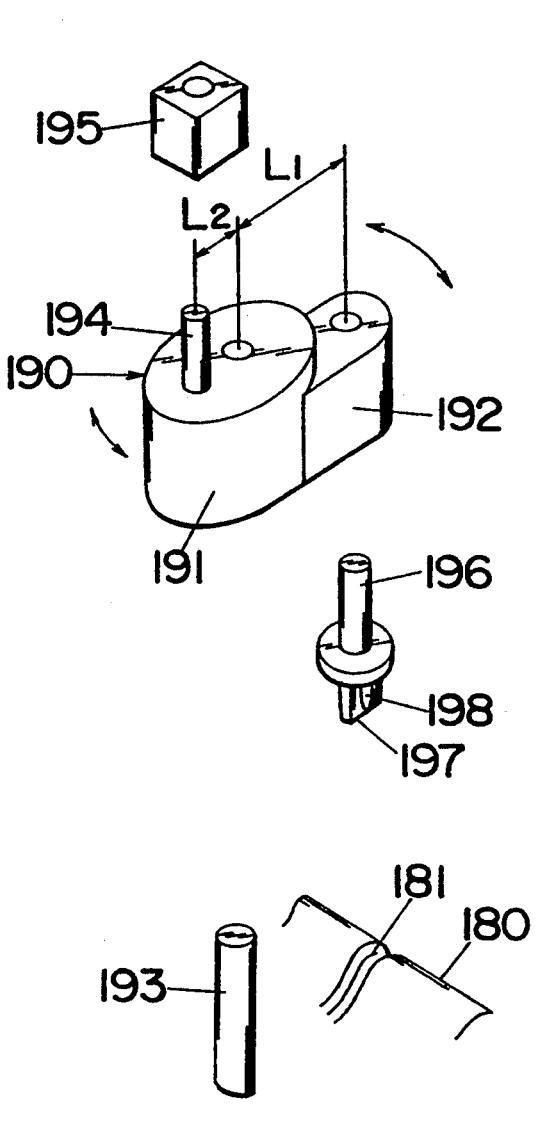
FIG. 21 is an enlarged exploded perspective view of an eccentric cam utilized in the above device.
Figure 22:
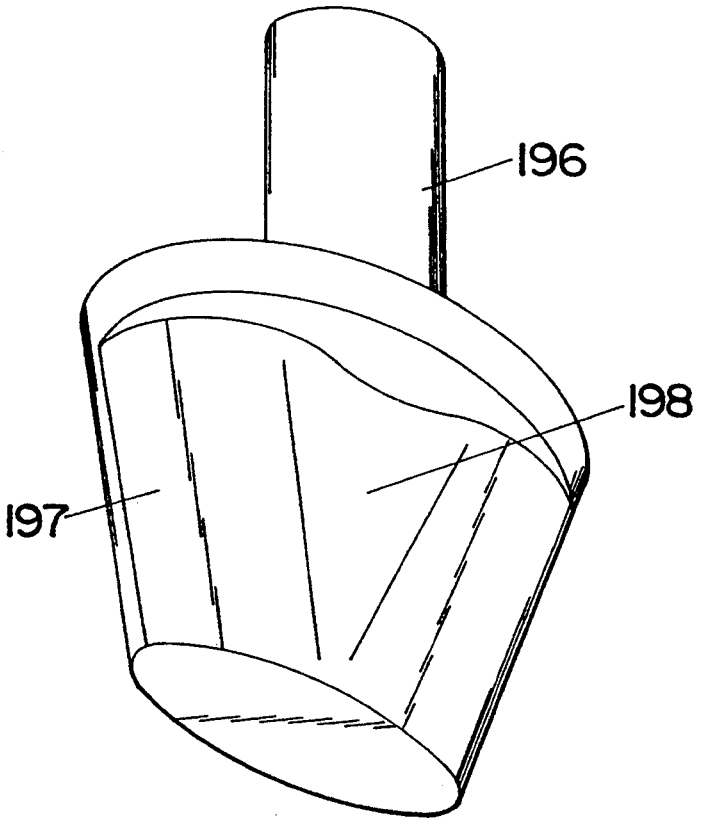
FIG. 22 is an exploded perspective view of a cam follower coupled to a positive-return cam included in the above device to axially displace the movable pinching plates.
Figure 23:
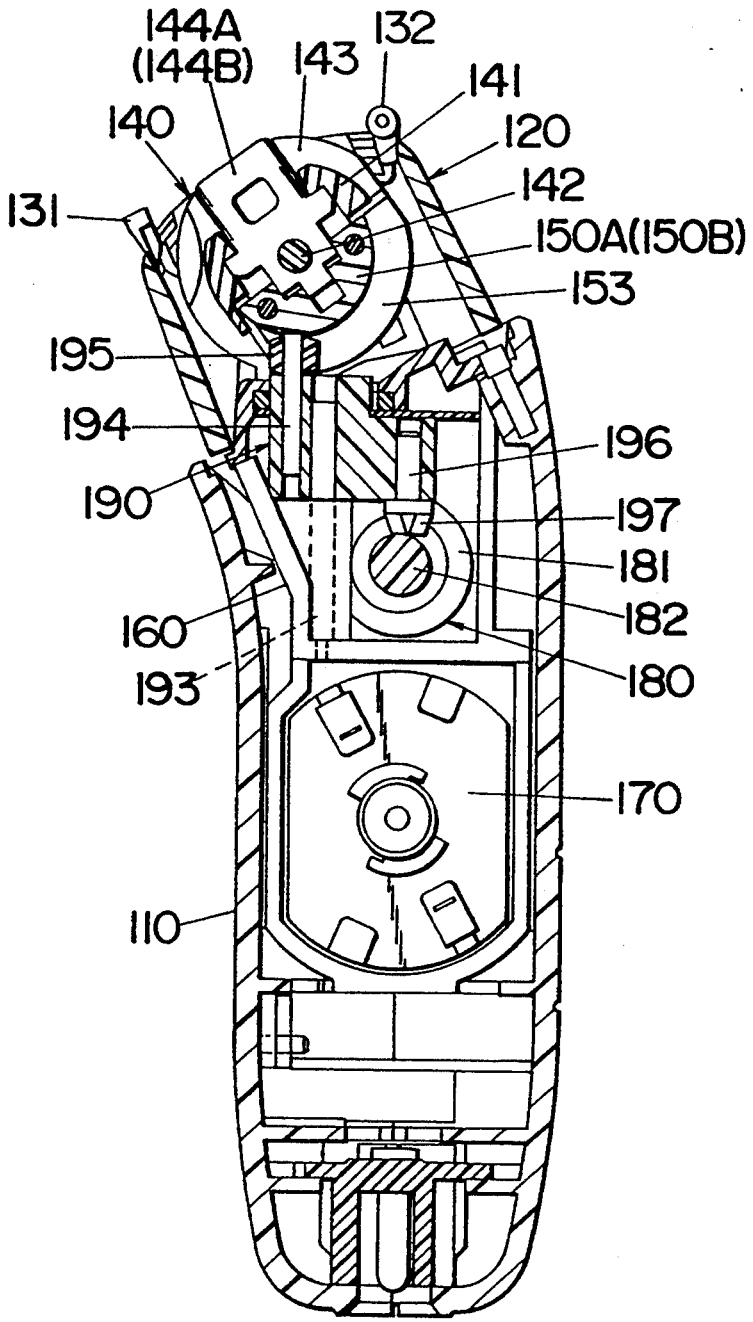
FIG. 23 is a vertical section taken along line III—III of FIG. 17.

The plucking assembly 140 employed in the second embodiment is identical to that of the first embodiment. Therefore, no further explanation is deemed necessary but it is repeated here that the assembly 140 includes a like carrier 141 rotatably supported on a shaft 142 and mounting a number of fixed pinching plates 143 alternated by movable pinching plates 144 and that the movable pinching plates consist of first and second plates 144A and 144B which are commonly supported loosely on the shaft 142 to be rotatable thereabout together with the carrier 141 and the fixed pinching plates 143. The first and second plates 144A and 144B are secured at their lower ends respectively to first and second sliders 150A and 150B which are slidably supported by axles 152 held in the lower end of the carrier 141 and which are driven to reciprocate in parallel with the shaft 142 but in the opposite directions to each other. The sliders 150A and 150B are operatively connected to the positive-return cam 180 by means of a pair of cam cylinders 190 each of which, as best shown in FIGS. 20 to 22, comprises a barrel 191 with a side projection 192. The barrel 191 is rotatable about a center vertical shaft 193 supported to the chassis 160 and is formed with an eccentric pin 194 which extends in parallel relation and eccentric to the vertical shaft 193 and carries a roller 195. The roller 195 is slidably received in an arcuate furrow 153 formed in the bottom of each of the sliders 150A and 150B. The side projection 192 receives an offset pin 196 which extends in parallel with the center vertical shaft 193 in an opposite relation to the eccentric pin 194 from the center vertical shaft 193. Provided at the lower end of each offset pin 196 is a cam follower 197 for slidable engagement into each one of grooves 181 of the positive-return cam 180 such that the rotation of the cam 180 is translated into reciprocating movement of the sliders 150A and 150B along the shaft 142 through a swinging movement of the cam cylinders 190, thereby displacing the movable pinching plates 144A and 144B in the axial direction to move their upper edge into abutment and away from the associated fixed pinching plates 143. It is noted here that, as shown in FIG. 21, a distance $L_1$ between the offset pin 196 carrying the cam follower 197 and the center vertical shaft 193 is made greater than a distance $L_2$ between the eccentric pin 114 and the center vertical shaft 193 so that the eccentric pin 194 can exert a correspondingly greater torque about the shaft 193 to thereby transmit a strong force for reciprocating the sliders 150A and 150B.

Figure 24:
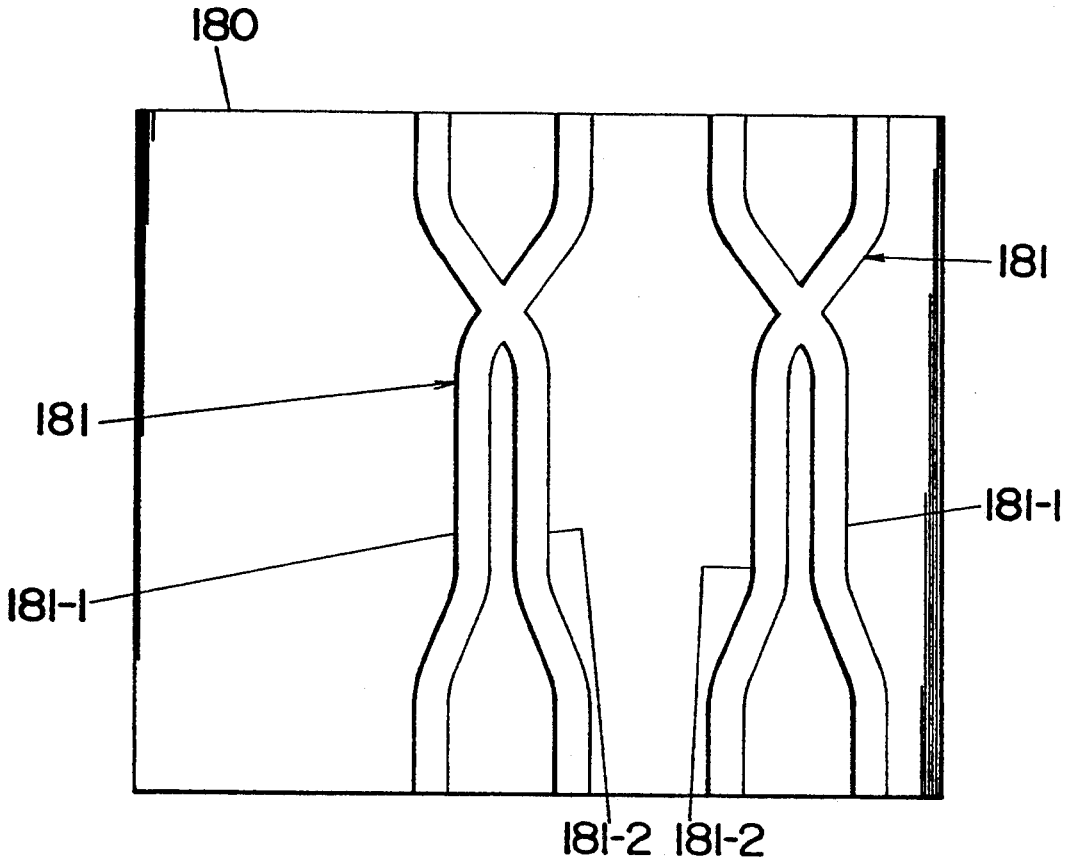
FIG. 24 is an expanded view of the positive-return cam.
Figure 25A:
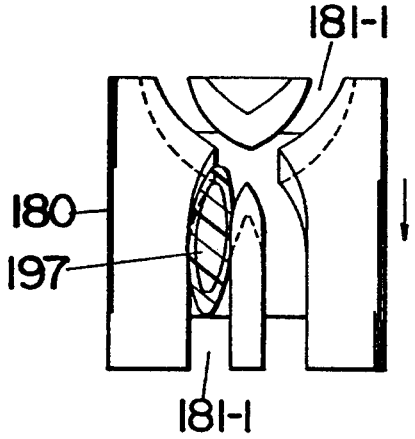
FIGS. 25A to 25F are explanatory views illustrating the movement of the cam follower in an X-shaped groove of the positive-return cam.
Figure 25D:
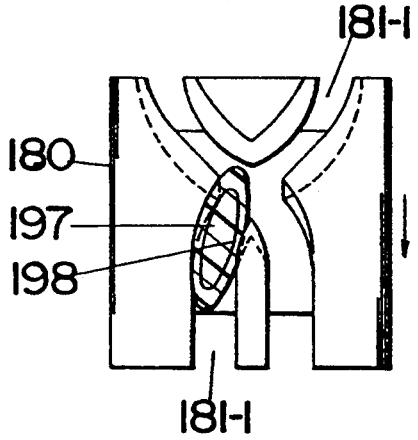
Figure 25B:
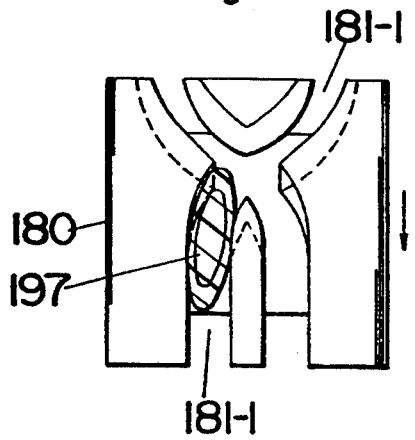
Figure 25E:
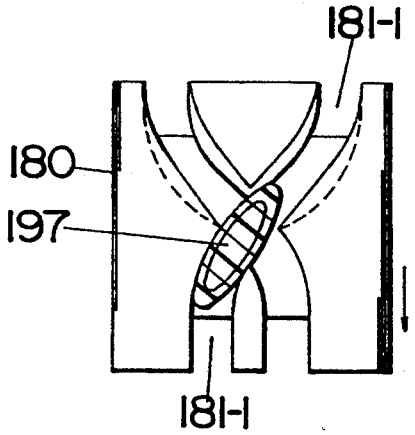
Figure 25C:
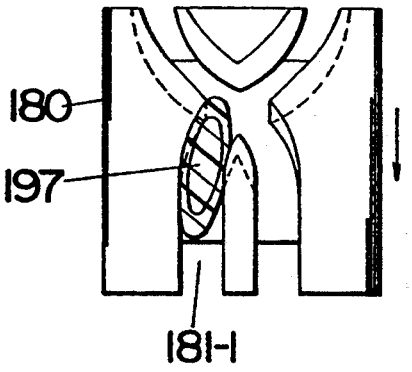
Figure 25F:
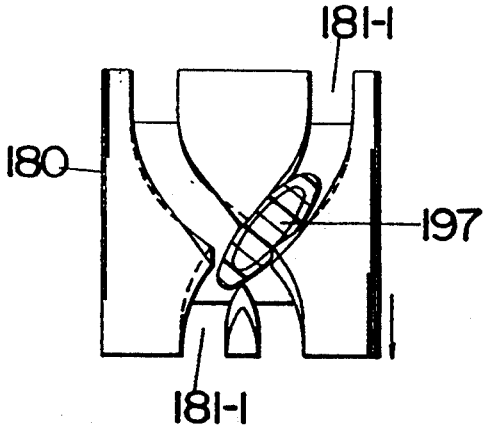

The positive-return cam 180 is provided in the form of a cylinder supported on a horizontally extending center shaft 182 to be rotatable therewith. The cam 180 is formed with a axially spaced pair of circumferentially extending grooves 181 which are symmetrical to each other such that the horizontal distance between the grooves 181 varies in the circumferential direction, as shown in FIG. 24. Each of the grooves 181 of a generally X-shaped to present first and second paths 181-1 and 181-2 which are inclined axially inwardly and outwardly, respectively with respect to the circumferential direction and are so crossed with each other at one point that the first path 181-1 is continuous at its axially inner and outer ends respectively with the axially inner and outer ends of the second path 181-2. Each of the cam followers 197 is configured to have a generally elliptic cross-section and is engaged into the X-shaped groove 181 such that the cam follower 197 follows the first and second paths 181-1 and 181-2 alternately as the cam 180 rotates about the axis of the shaft 182. That is, the cam follower 197 will travel the first path 181-1 to be thereby displaced axially inwardly per one turn of the cam 180 and then travel the second path 181-2 to be displaced axially outwardly per next one turn of the cam 180. In this manner, the cam follower 197 repeats to move axially inwardly and outwardly as the cam 80 rotates in one direction, thereby driving to reciprocate the sliders 150A and 150B in the axially direction for displacing the movable pinching plates 144A and 144B toward and away from the associated fixed pinching plates 143. The cam follower 197 can be smoothly guided past the cross through the first and second paths 181-1 and 181-2 mainly due to the elliptic configuration of the cam follower 197 and also due to rounded concavities 198 formed in the opposite sides of the cam follower 197, as seen in FIG. 22. An explanation is made to this point with reference to FIGS. 25A to 25F. As the cam 180 rotates in the direction indicated by an arrow in the figures, the cam follower 197 proceed through the first path 181-1 [FIGS. 25A to 25C] to the cross. When the cam follower 197 proceeds further to have its leading edge into the cross [FIG. 25D], the edge of the side wall of the groove 181-1 is allowed to come into the concavity 198 and slide therealong to thereby orient the leading edge inwardly [FIG. 25E], after which the cam follower 197 can proceed past the cross and follow the first groove 181-1 [FIG. 25F]. Although not shown in the figure, the same behavior is seen when the cam follower 197 travels the second path 181-2 past the cross.

Figure 17:
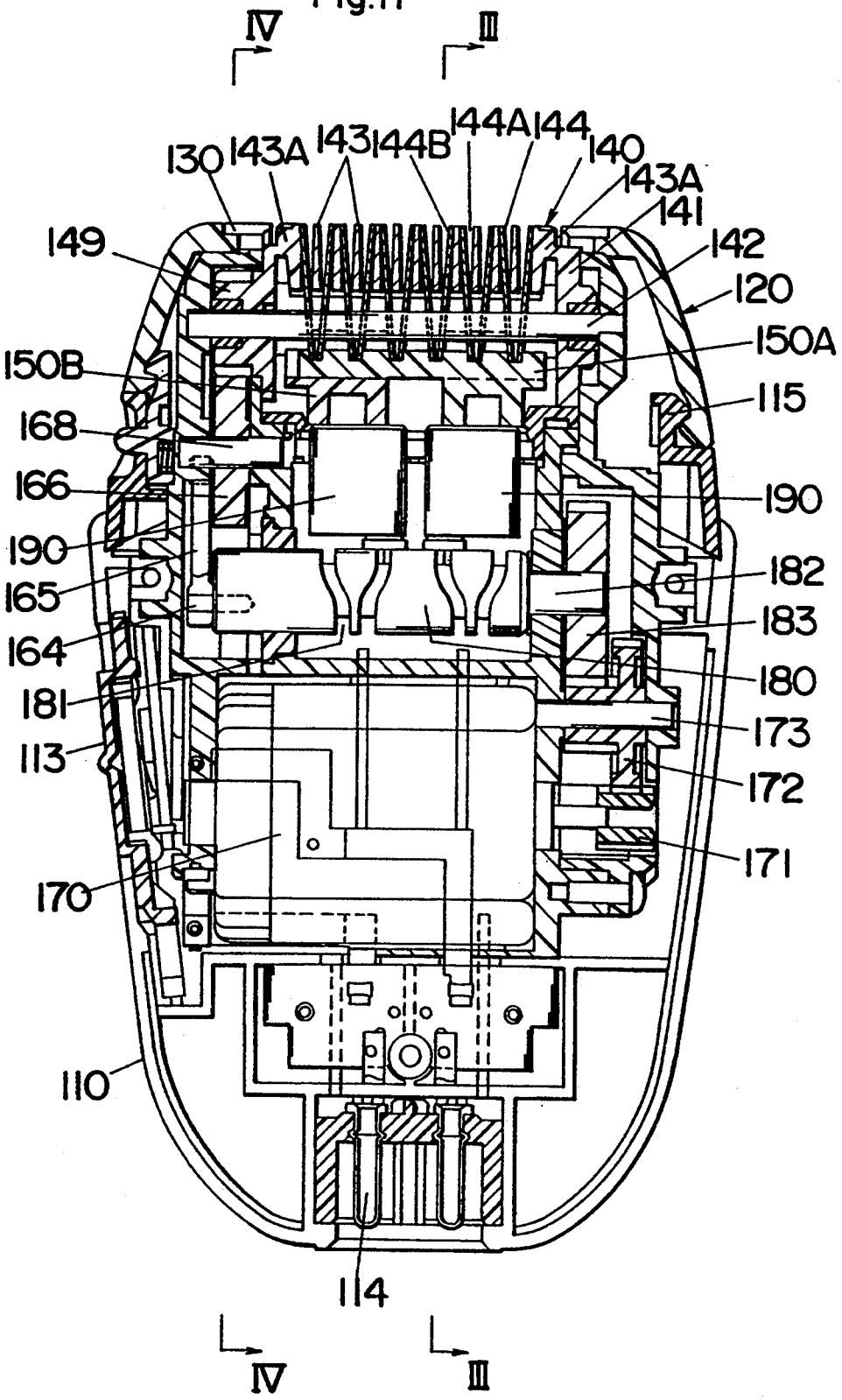
FIG. 17 is a vertical section of the depilating device.
Figure 18:
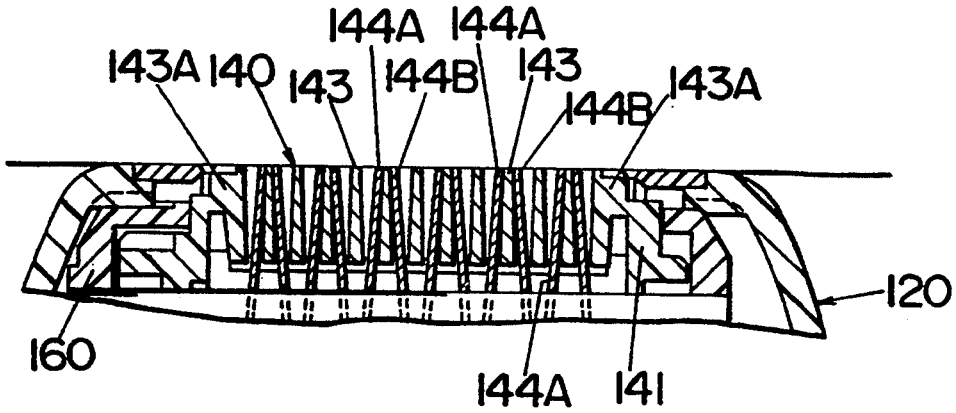
FIG. 18 is a partial vertical section of the device of FIG. 17 with the movable pinching plates shown in one axially displaced position opposite to that shown in FIG. 17.
Figure 27:
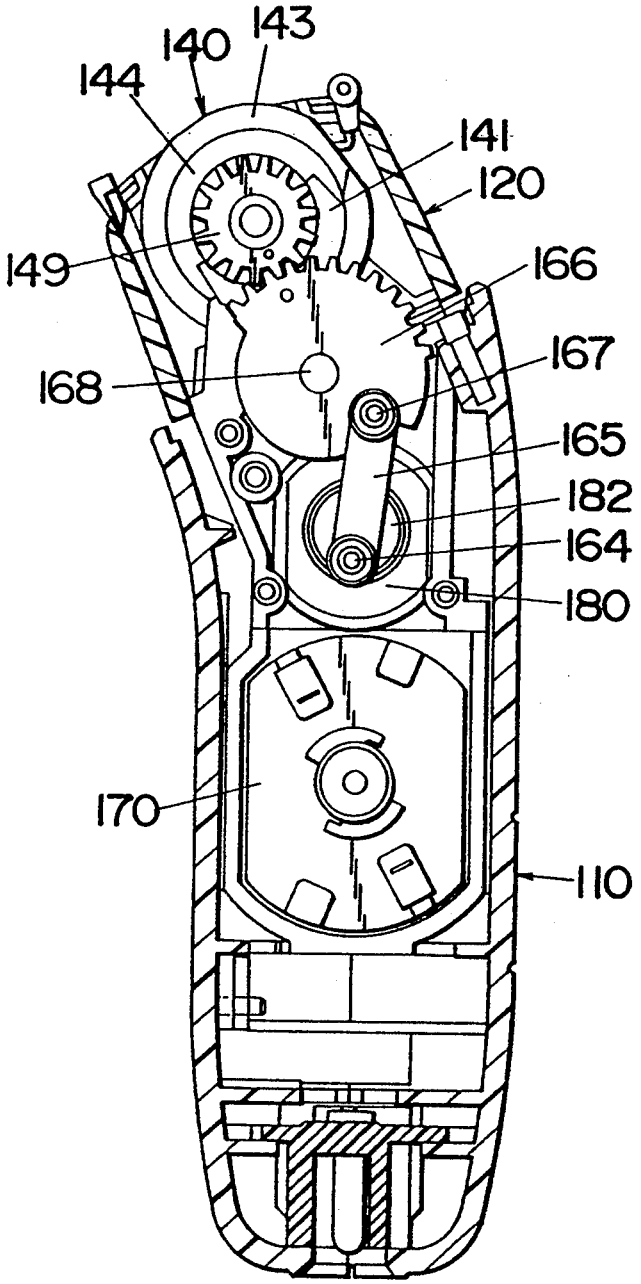
FIG. 27 is a vertical section taken along line IV—IV of FIG. 17.
Figure 28A:
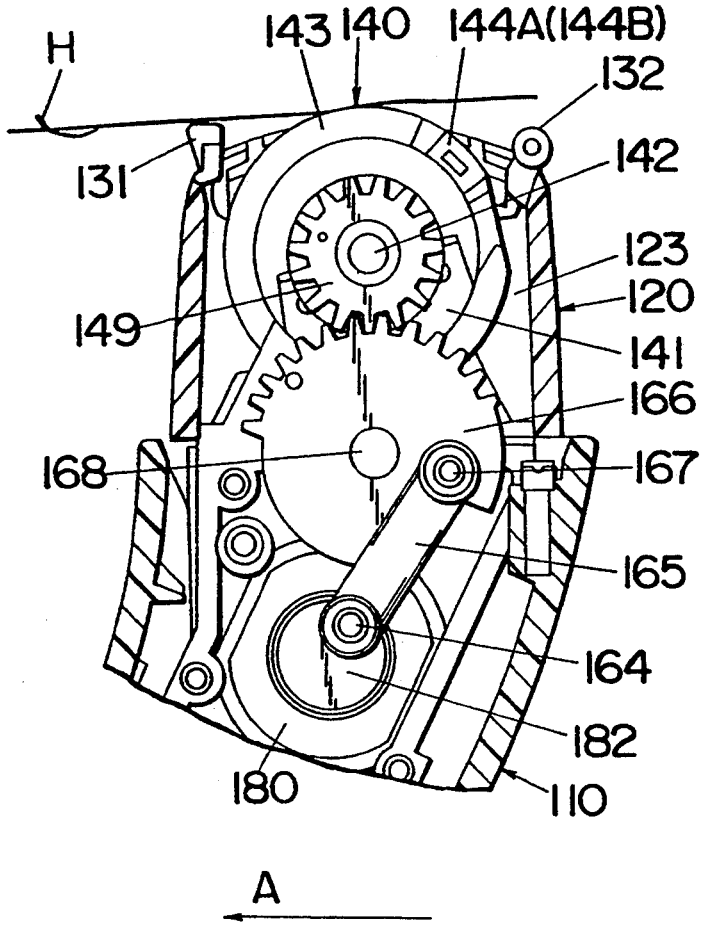

The motor 170 is operatively connected to the positive-return cam 180 through a reduction gear train of a pinion 171 of the motor 170, a first gear 172 gear on a first shaft 173 and a second gear 183 on one end of the shaft 182 of the positive-return cam 180. The cam 180 is linked to one end of a crank lever 165 at the end opposite of the second gear 183 by means of an eccentric pin 164 which is eccentric to the axis of the shaft 182, as shown in FIGS. 17 and 27. The other end of the crank lever 165 is coupled to a partially toothed rack wheel 166 by means of a pivot pin 167 which is eccentric to a shaft 168 carrying the rack wheel 166. The rack wheel 166 is in meshing engagement with a gear 149 on one end of the shaft 142 of the carrier 141 so that the rotation of the eccentric pin 164 about the center shaft 182 or of the positive-return cam 180 is translated into an oscillating rotary movement of the rack wheel 166 about the shaft 168 and therefore the corresponding movement of the gear 149 or the plucking assembly 140 about the shaft 142. That is, the plucking assembly 140 is caused to oscillate about the shaft 142 in synchronism with the plucking movement of displacing the movable pinching plates 144 in the axial direction of the shaft 142, and is so arranged to complete one oscillation cycle while the positive-return cam 180 rotates one rotation about the center shaft 182 such that the movable pinching plate 144 is caused to move toward and away from one of the two adjacent fixed pinching plates 143 during one oscillation cycle of the plucking assembly 140 about the shaft 142 and to move toward and away from the other fixed pinching plate 143 during subsequent oscillation cycle of the plucking assembly 140.

Figure 29A:
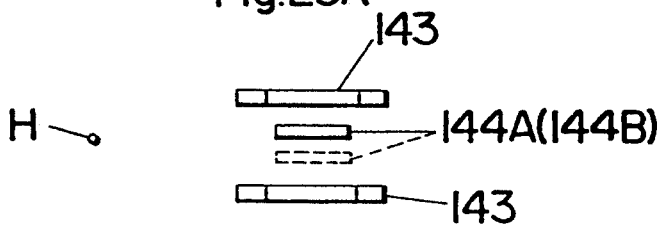
Figure 28B:
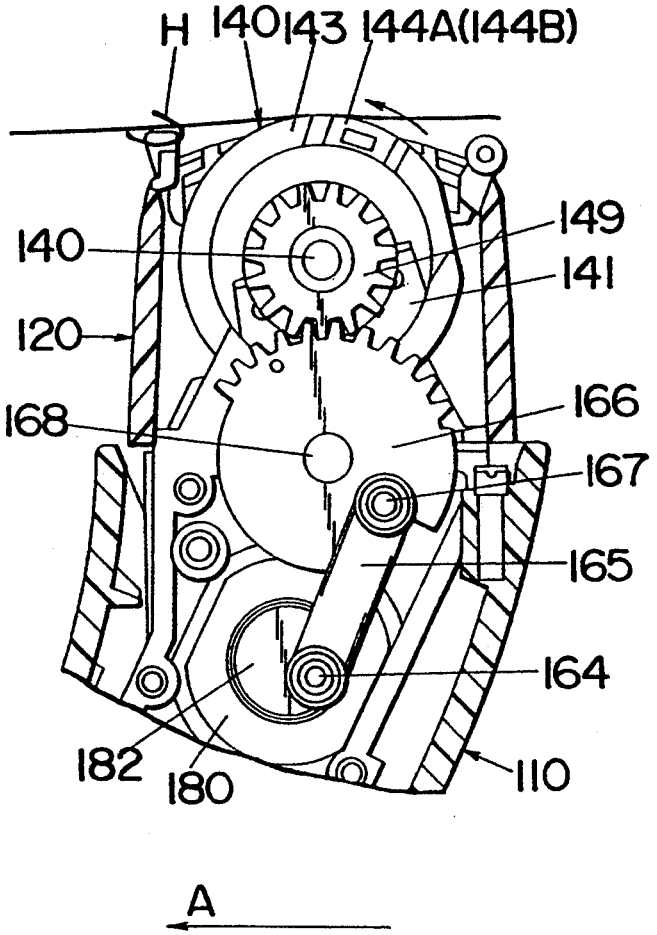
Figure 29B:
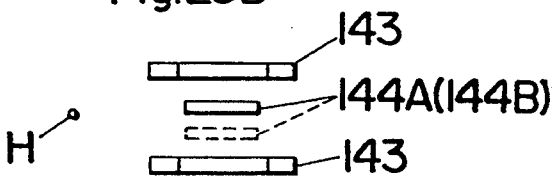
Figure 28D:
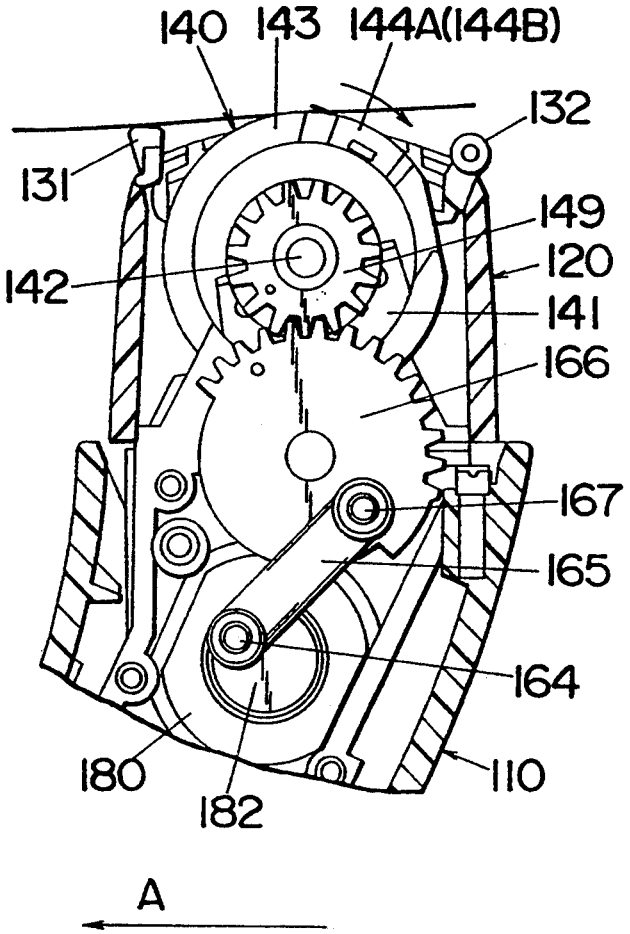
Figure 29D:
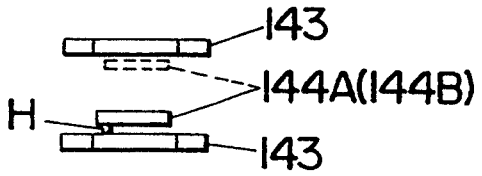
Figure 28E:
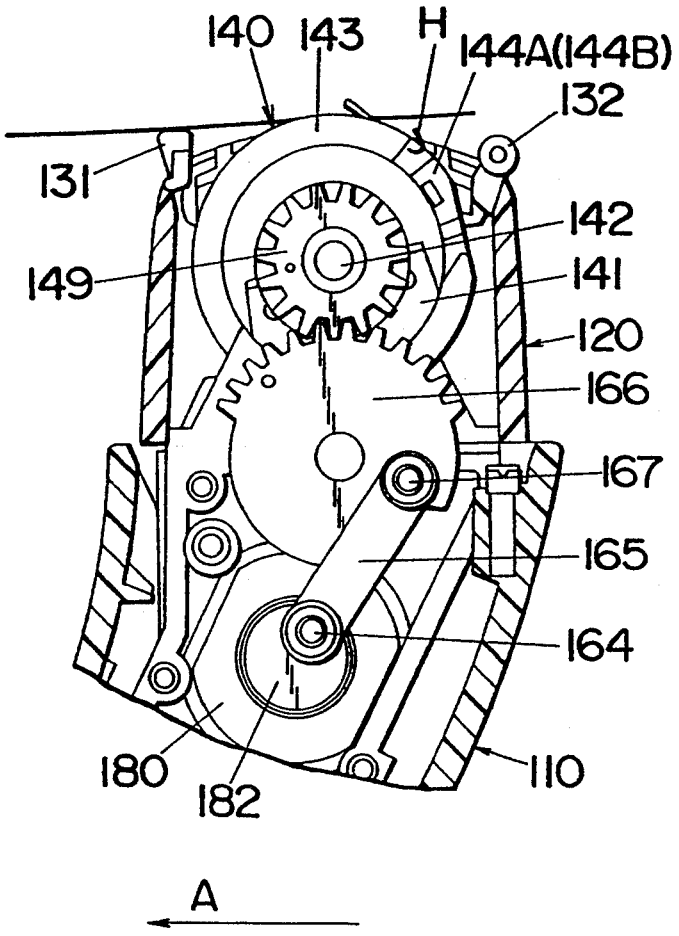
Figure 29E:
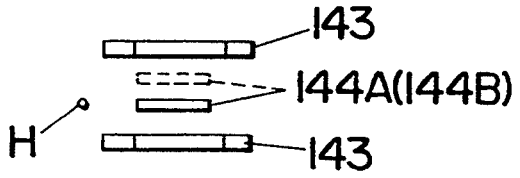
Figure 30:
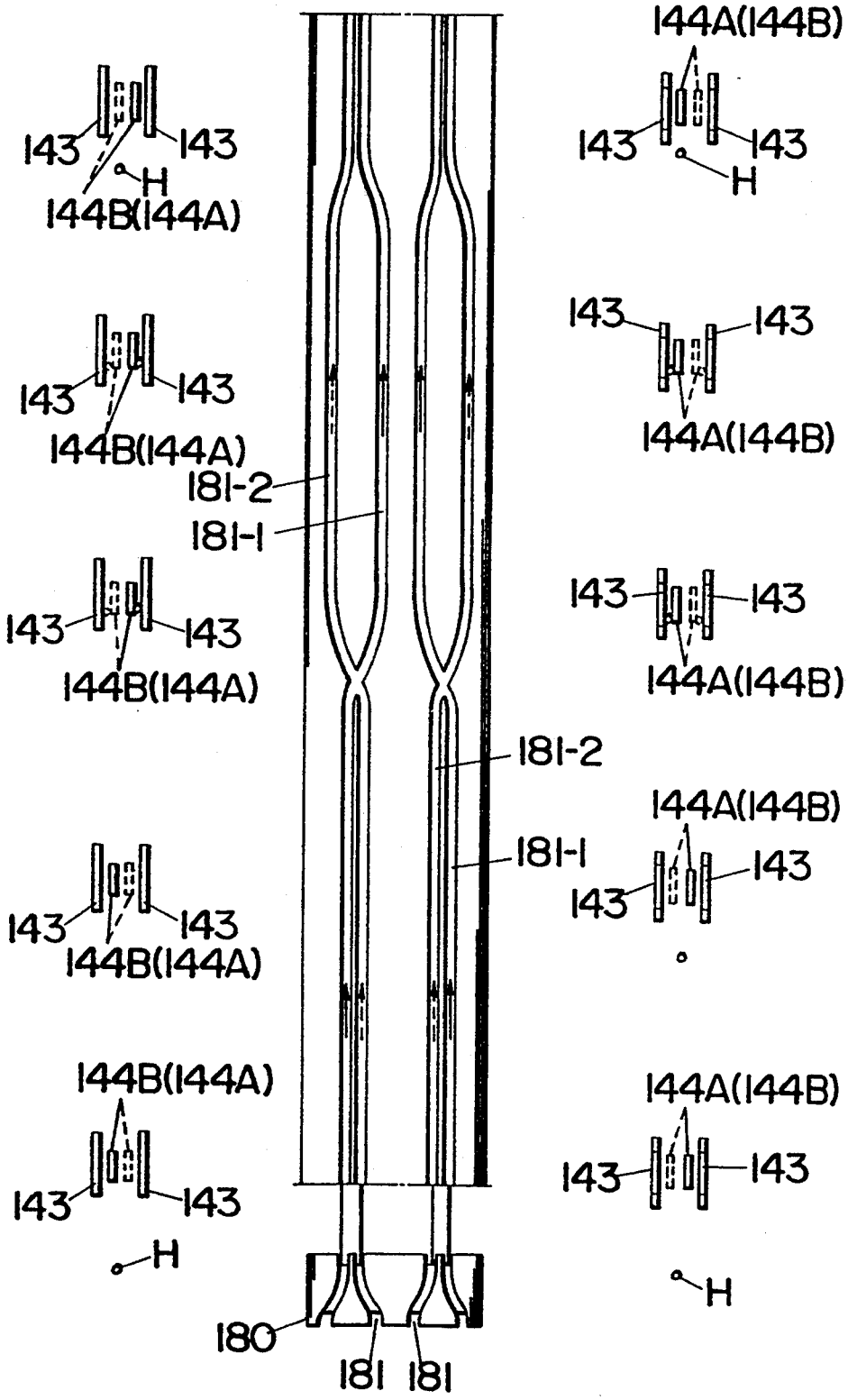
FIG. 30 is an expanded view of the positive-return cam shown with the clamping operations of the movable pinching plates effected at points of the X-shaped grooves.

The operation of the plucking assembly 140 will be now discussed with reference to FIGS. 28A to 28E and 29A to 29E which illustrate in sequence one oscillation cycle of the plucking assembly 140 about the shaft 142. When the plucking assembly 140 is in a position of FIG. 28A, the upper edge of the movable pinching plate 144 is angularly displaced downward to be hidden within the opening 123 of the depilator head 120 and at the same time the movable pinching plate 144 is kept in a neutral position where the upper edge thereof is spaced axially along the shaft 142 from both of the two adjacent fixed pinching plates 143, as shown by solid lines in FIG. 29A. It is noted here that dotted lines in FIGS. 29A to 29E show the positions of the same movable pinching plate 144 taken during the next oscillation cycle of the plucking assembly 140. As the plucking assembly 140 rotates in a counter-clockwise direction in the figure about the shaft 142 from the position of FIG. 28A to a position of FIG. 28B to rotate the movable pinching plates 144 for exposure into the opening 123 of the depilator head 120 while advancing the head 120 along the user's skin in the direction indicated by an arrow A in the figures, the movable pinching plate 144 is still kept in spaced relation to the two adjacent fixed pinching plates 143, as shown in FIG. 29B, so as to be ready for entrapping the hair H into a clearance between the movable pinching plate 144 and the fixed pinching plate 143. When the plucking assembly 140 is rotated further to the position of FIG. 28C while being further advanced in the direction of the arrow A, the movable pinching plate 144 is caused to axially shifted to have its upper edge engaged with one of the two adjacent fixed pinching plates 143 to clamp the hair H therebetween, as shown in FIG. 29C. Thereafter, the plucking assembly 140 is caused to rotate in the reverse direction, i.e., clockwise direction in,the figure to a position of FIG. 28D, at which condition, the movable pinching plate 144 is kept in closed relation to the corresponding fixed pinching plate 143 So as to keep clamping the hair H therebetween, as shown in FIG. 29D, to thereby pull and remove the hair from the skin as the plucking assembly 140 rotates about the shaft 142. Subsequently, when the plucking assembly 140 is further rotated in the clockwise direction to return to a position of FIG. 28E which is the same position of FIG. 28A, the movable pinching plate 144 is caused to move away from the fixed pinching plate 143 and returns into the neutral position, during which the hair H is released and flew circumferentially out of the plucking assembly 140 by a centrifugal force acting thereon. At this time, the positive-return cam 180 has completed one rotation so that, in the immediately subsequent one oscillation cycle of the plucking assembly 140 or subsequent one rotation of the cam 180, the movable pinching plate 144 is caused to move toward and away from the other fixed pinching 143, as shown in the dotted lines of FIGS. 29A to 29E, so as to cooperate therewith for effecting the like plucking operation. The above operation can be also confirmed from FIG. 30 which shows the positions of the movable pinching plates 144A and 144B relative to the adjacent fixed pinching plates 143 in correspondence to the positions of the associated sliders 150A and 150B along the circumference of the positive-return cam 180. In the figure, solid lines denote the positions of the movable pinching plates 140A and 140B and the paths of the cam followers 197 in the first grooves 181-1 during one rotation of the cam 180 and the dotted lines denote the same when the cam followers 197 travels in the second grooves 181-2 during the subsequent one rotation of the cam 180.

Figure 26A:
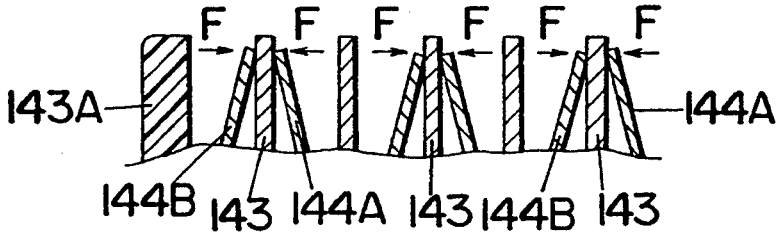
FIGS. 26A and 26B are explanatory views illustrating the movable pinching plates in two axially displaced positions.
Figure 26B:
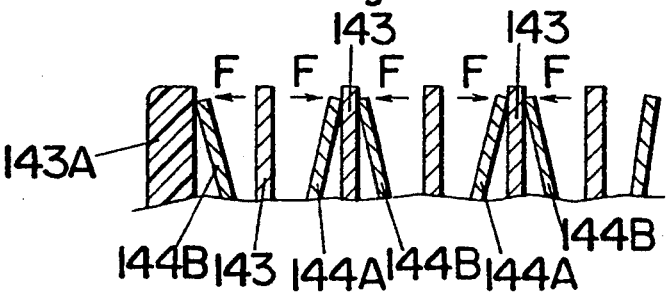

In this manner, each movable pinching plate 144 is caused to move axially along the shaft 142 between the two adjacent fixed pinching plates 143 to clamp the hair with the one fixed pinching plate 143 at a time and the hair with the other fixed pinching plate 143 at the other. Thereby, a whole distance between the two adjacent fixed plates 143 can be best utilized as an effected plucking length. It should be noted here that, since the set of alternate movable pinching plates 144A and the other alternate set of the movable pinching plates 144B are caused to move in the opposite direction along the shaft 142, the two adjacent movable pinching plates 144A and 144B are simultaneously brought into abutment against the one common fixed pinching plate 143 positioned therebetween to apply counterbalancing forces F to the fixed pinching plate 143 at a time, as shown in FIG. 26A (during one rotation cycle of the cam 180) and in FIG. 26B (during the next one rotation cycle), thus canceling otherwise occurring undesired vibrations of the fixed pinching plates 43 and therefore minimizing the operation noise.

Figure 6A:
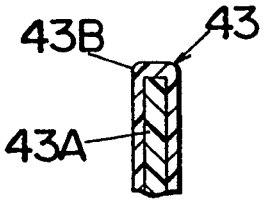
FIGS. 6A and 6B are respectively partial sectional views of the fixed pinching plates which may be equally utilized in the above device.
Figure 6B:
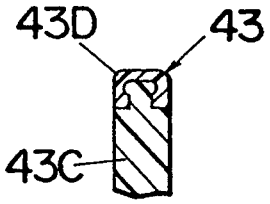

It should be stressed that the fixed pinching plates 143 can be made from rather elastic material into a composite structure with a core and a outer layer of greater elasticity than the core, as disclosed in the first embodiment with reference to FIGS. 6A and 6B, in order to minimize the impact at the collision against the movable pinching plates for further improving the low-noise operation. Also, the fixed pinching plates 143 and the carrier 141 may be formed form a plastic material incorporating antistatic agent for avoiding the accumulation of static electricity during the continued operation of the device. Further, the plucking assembly 140 of the second embodiment includes a pair of end fixed pinching plates 143A on the axial ends of the carrier 141, as shown in FIGS. 17, 18, 26A and 26B. The end fixed pinching plates 143A is configured to have a greater thickness and therefore greater rigidity than the other fixed pinching plates 143 such that the end fixed pinching plates 143A can additionally act bumpers for protecting the movable pinching plates 144 and the other fixed pinching plates 143 from being damaged such as when the device is dropped onto the floor.

In the second embodiment, the chassis 160 includes a pair of end covers 162 each carrying a tubular bushing 163 on its outer surface, as shown in FIG. 20. The bushing 163 is made of an elastic material such as rubber to have a mount hole through which a screw 169 extends into a corresponding boss 119 on one of housing halves 111 and 112. Thus, the chassis 160 supporting a number of moving parts including the motor 170 and the plucking assembly 140 is floatingly supported within the housing 11O such that the plucking assembly 140 is capable of readily following the contour of the skin without irritating the skin for assuring smooth and effective plucking operation.

What is claimed is:

1. A depilating device for removing hairs from the skin of a user, said device comprising:

a carrier having a longitudinal axis and mounting a series of fixed and movable pinching plates arranged along an axial direction of said carrier, said fixed pinching plates being fixed in said axial direction and said movable pinching plates being movable in said axial direction, said fixed and movable pinching plates being positioned in a closely adjacent relation to define small clearances between the fixed pinching plates and adjacent movable pinching plates for entrapping hairs therebetween;

shuttle means connected to said movable pinching plates to displace said movable pinching plates relative to the adjacent fixed pinching plates along said axial direction in order to repeatedly clamp the hairs between adjacent fixed and movable pinching plates and releasing the same, thereby plucking the hairs from the skin; and wherein said fixed and movable pinching plates are arranged on said carrier and connected to said shuttle means such that the shuttle means displaces adjacent movable pinching plates in opposite directions along the longitudinal axis of said carrier, each of the adjacent movable pinching plates thereby being pivoted toward different adjacent fixed pinching plates in a clamping movement, providing a clamping force therebetween, and wherein said movable pinching plates on opposite sides of a common fixed pinching plate apply counterbalancing clamping forces thereto, resulting in a clamping and releasing movement of said movable pinching plates.

2. A depilating device as set forth in claim 1, further comprising drive means coupled to said carrier to oscillate said carrier about said longitudinal axis with said fixed and movable pinching plates in synchronism with said clamping and releasing movement of said movable pinching plates, said movable pinching plates arranged to alternate with said fixed pinching plates along the longitudinal axis of said carrier, and wherein said shuttle means moves said movable pinching plates such that said clamping movement occurs at each first alternate one of said fixed pinching plates during one complete oscillation cycle of said carrier about said longitudinal axis and said clamping movement occurs at each second alternate one of said fixed pinching plates in a subsequent one oscillation cycle of said carrier about said longitudinal axis.

3. A depilating device as set forth in claim 1, wherein said fixed pinching plates are made of an elastic material.

4. A depilating device as set forth in claim 6, wherein said fixed pinching plates are of a composite structure, each composed of a core member and an outer member having elasticity greater than that of said core member.

5. A depilating device for removing hairs from the skin of a user, said device comprising:

a carrier having a longitudinal axis and mounting a series of fixed and movable pinching plates arranged along an axial direction of said carrier, said fixed pinching plates being fixed in said axial direction and said movable pinching plates being movable in said axial direction, said fixed and movable pinching plates being positioned in a closely adjacent relation to define small clearances between the fixed pinching plates and adjacent movable pinching plates for entrapping hairs therebetween; and shuttle means connected to said movable pinching plates to displace said movable pinching plates relative to the adjacent fixed pinching plates along said axial direction in order to repeatedly clamp the hairs between adjacent fixed and movable pinching plates and releasing the same, thereby plucking the hairs from the skin, said shuttle means comprising first and second sliders which reciprocate in parallel with said longitudinal axis of said carrier but in opposite directions to each other, wherein each of said first and second sliders are connected to each alternate one of said movable pinching plates for displacing the adjacent movable pinching plates in opposite directions along the longitudinal axis of said carrier, wherein said fixed and movable pinching plates are arranged on said carrier and connected to said shuttle means such that the shuttle means displaces adjacent movable pinching plates in opposite directions along the longitudinal axis of said carrier, each of the adjacent movable pinching plates thereby being pivoted toward different adjacent fixed pinching plates in a clamping movement, providing a clamping force therebetween, and wherein said movable pinching plates on opposite sides of a common fixed pinching plate apply counterbalancing clamping forces thereto, resulting in a clamping and releasing movement of said movable pinching plates.

6. A depilating device for removing hairs from the skin of a user which comprises:

a carrier having a longitudinal axis and mounting a series of fixed and movable pinching plates arranged along an axial direction of said carrier, said fixed pinching plates being fixed in said axial direction and said movable pinching plates being movable in said axial direction, said fixed and movable pinching plates being positioned in a closely adjacent relation to define small clearances between the fixed pinching plates and adjacent movable pinching plates for entrapping hairs therebetween, wherein said fixed pinching plates are molded integrally with said carrier; and shuttle means connected to said movable pinching plates to displace said movable pinching plates relative to the adjacent fixed pinching plates along said axial direction in order to repeatedly clamp the hairs between adjacent fixed and movable pinching plates and releasing the same, thereby plucking the hairs from the skin, wherein said fixed and movable pinching plates are arranged on said carrier and connected to said shuttle means such that the shuttle means displaces adjacent movable pinching plates in opposite directions along the longitudinal axis of said carrier, each of the adjacent movable pinching plates thereby being pivoted toward different adjacent fixed pinching plates in a clamping movement, providing a clamping force therebetween, and wherein said movable pinching plates on opposite sides of a common fixed pinching plate apply counterbalancing clamping forces thereto, resulting in a clamping and releasing movement of said movable pinching plates.

7. A depilating device for removing hairs from the skin of a user which comprises:

a carrier having a longitudinal axis and mounting a series of fixed and movable pinching plates arranged along an axial direction of said carrier, said fixed pinching plates being fixed in said axial direction and said movable pinching plates being movable in said axial direction, said fixed and movable pinching plates being positioned in a closely adjacent relation to define small clearances between the fixed pinching plates and adjacent movable pinching plates for entrapping hairs therebetween, wherein two outer ones of said fixed pinching plates located on axial ends of said carrier are formed to have rigidity greater than that of the remaining fixed pinching plates; and shuttle means connected to said movable pinching plates to displace said movable pinching plates relative to the adjacent fixed pinching plates along said axial direction in order to repeatedly clamp the hairs between adjacent fixed and movable pinching plates and releasing the same, thereby plucking the hairs from the skin, wherein said fixed and movable pinching plates are arranged on said carrier and connected to said shuttle means such that the shuttle means displaces adjacent movable pinching plates in opposite directions along the longitudinal axis of said carrier, each of the adjacent movable pinching plates thereby being pivoted toward different adjacent fixed pinching plates in a clamping movement, providing a clamping force therebetween, and wherein said movable pinching plates on opposite sides of a common fixed pinching plate apply counterbalancing clamping forces thereto, resulting in a clamping and releasing movement of said movable pinching plates.

8. A depilating device for removing hairs from the skin of a user comprising:

a housing having a top opening therein, with a periphery of said top opening lying in a generally flat plane;

a plurality of pinching blades accommodated within said housing and arranged adjacent each other along a longitudinal axis in a closely spaced relation to define small clearances between tips of the adjacent blades, thereby entrapping hairs therebetween;

first drive means coupled to a portion of said plurality of pinching blades for displacing at least one of a pair of adjacent blades along said longitudinal axis to repeatedly clamp the hairs between the tips of the adjacent blades, and subsequently releasing the hairs;

second drive means coupled to said plurality of pinching blades for reciprocating said pinching blades along an inclined path extending in an inclined relation to said generally flat plane of the periphery of said top opening between an extended position where the tips of the blades reach said opening in engageable relation to the hairs on the skin and a retracted position where the tips of the blades are retracted in the housing away from said opening; and said first and second drive means cooperating wherein said blades have their tips close as said tips move along said inclined path from said retracted position to said extended position and that said blades have their tips open as said tips move along said inclined path from said extended position to said retracted position.

9. A depilating device as set forth in claims 8 or 10, wherein said fixed pinching plates are made of an elastic material.

10. A depilating device for removing hairs from the skin of a user comprising:

a housing with a top opening;

a carrier accommodated within said housing and having a longitudinal axis, said carrier supporting a plurality of pinching blades arranged adjacent each other in a closely spaced relation along said longitudinal axis to define small clearances between the adjacent blades, for entrapping the hairs therebetween;

first drive means coupled to at least a portion of said plurality of pinching blades, for displacing at least one of a pair of adjacent blades along said longitudinal axis to repeatedly clamp the hairs between the tips of the adjacent blades, and subsequently releasing the hairs;

second drive means coupled to said carrier for reciprocating said carrier along an arcuate path about said longitudinal axis between an extended position where the tips of the blades reach said opening in engageable relation to the hairs on the skin and a retracted position where the tips of the blades are retracted in the housing away from said opening; and said first and second drive means cooperating wherein said blades have their tips close as said tips move along said arcuate path from said retracted position to said extended position and that said blades have their tips open as said tips move along said arcuate path from said extended position to said retracted position.

11. A depilating device for removing hairs from the skin of a user which comprises:

a carrier having a longitudinal axis and mounting a series of fixed and movable pinching plates arranged along an axial direction of said carrier, said fixed pinching plates being fixed in said axial direction and said movable pinching plates being movable in said axial direction, said fixed and movable pinching plates being positioned in a closely adjacent relation to define small clearances between the fixed pinching plates and adjacent movable pinching plates for entrapping hairs therebetween; and shuttle means connected to said movable pinching plates to displace said movable pinching plates relative to the adjacent fixed pinching plates along said axial direction in order to repeatedly clamp the hairs between adjacent fixed and movable pinching plates and releasing the same, thereby plucking the hairs from the skin, said shuttle means further comprising a horizontally disposed shaft to support the fixed and movable pinching plates, at least one slider supporting said movable pinching plates, said at least one slider being moved by a motor having a horizontally mounted shaft, and a gear assembly coupled to said horizontally mounted shaft and said at least one slider, for moving said slider to displace said movable pinching plates;

wherein said fixed and movable pinching plates are arranged on said carrier and connected to said shuttle means such that the shuttle means displaces adjacent movable pinching plates in opposite directions along the longitudinal axis of said carrier, each of the adjacent movable pinching plates thereby being pivoted toward different adjacent fixed pinching plates in a clamping movement, providing a clamping force therebetween, and wherein said movable pinching plates on opposite sides of a common fixed pinching plate apply counterbalancing clamping forces thereto, resulting in a clamping and releasing movement of said movable pinching plates.

12. A depilating device for removing hairs from the skin of a user which comprises:

a carrier having a longitudinal axis and mounting a series of fixed and movable pinching plates arranged along an axial direction of said carrier, said fixed pinching plates being fixed in said axial direction and said movable pinching plates being movable in said axial direction, said fixed and movable pinching plates being positioned in a closely adjacent relation to define small clearances between the fixed pinching plates and adjacent movable pinching plates for entrapping hairs therebetween, wherein said fixed pinching plates are made of an elastic material, and wherein said fixed pinching plates are of a composite structure, each composed of a core member and an outer member having elasticity greater than that of said core member; and shuttle means connected to said movable pinching plates to displace said movable pinching plates relative to the adjacent fixed pinching plates along said axial direction in order to repeatedly clamp the hairs between adjacent fixed and movable pinching plates and releasing the same, thereby plucking the hairs from the skin;

wherein said fixed and movable pinching plates are arranged on said carrier and connected to said shuttle means such that the shuttle means displaces adjacent movable pinching plates in opposite directions along the longitudinal axis of said carrier, each of the adjacent movable pinching plates thereby being pivoted toward different adjacent fixed pinching plates in a clamping movement, providing a clamping force therebetween, and wherein said movable pinching plates on opposite sides of a common fixed pinching plate apply counterbalancing clamping forces thereto, resulting in a clamping and releasing movement of said movable pinching plates.

* * * * *